US009873489B2

(12) United States Patent
De Kock et al.

(10) Patent No.: US 9,873,489 B2
(45) Date of Patent: Jan. 23, 2018

(54) MARKER-BUOY DEPLOYMENT SYSTEM

(71) Applicant: Opticast L.L.C., Andover, MN (US)

(72) Inventors: Andrew De Kock, Andover, MN (US); David Durand, Osceola, WI (US)

(73) Assignee: OptiCast L.L.C., Andover, MN (US)

( * ) Notice: Subject to any disclaimer, the term of this patent is extended or adjusted under 35 U.S.C. 154(b) by 64 days.

(21) Appl. No.: 14/812,890

(22) Filed: Jul. 29, 2015

(65) Prior Publication Data

US 2016/0031530 A1 Feb. 4, 2016

Related U.S. Application Data

(60) Provisional application No. 62/032,153, filed on Aug. 1, 2014.

(51) Int. Cl.
*B63B 22/00* (2006.01)
*B63B 22/16* (2006.01)

(52) U.S. Cl.
CPC ..... *B63B 22/003* (2013.01); *B63B 22/16* (2013.01)

(58) Field of Classification Search
CPC ..... B63B 22/00; B63B 22/18; B63B 22/24; B63B 22/003; B63B 22/16; B63B 2241/10; B63B 5/24; B63C 9/26
See application file for complete search history.

(56) References Cited

U.S. PATENT DOCUMENTS 1,773,462 A * 8/1930 Lambdin ..... B63C 9/22 114/190
2,418,549 A * 4/1947 De Rugeris ..... B63B 22/10 116/173
3,505,926 A * 4/1970 Johnson ..... B63C 9/26 102/504
3,696,453 A * 10/1972 Harris ..... B63C 9/22 114/190

(Continued)

OTHER PUBLICATIONS

R.M. Industries, Inc., Best Buoy, Underwater Marker. 2011 [online] Purdy, MO. [retrieved on Feb. 24, 2017]. Retrieved from <http://www.rmind.com/products/product.php?id_prod=5>.

*Primary Examiner* — Melba Bumgarner
*Assistant Examiner* — Amir Klayman
(74) *Attorney, Agent, or Firm* — Craige Thompson; Thompson Patent Law

(57) ABSTRACT

Apparatus and associated methods relate to a marker-buoy deployment system having a launching module that becomes armed by inserting a marker buoy, then laterally launches a loaded marker buoy in response to a user command. In an illustrative embodiment, launching module may be spring operated. In some embodiments, the release device may be foot operated. In an exemplary embodiment, a safety device may prevent an accidental launch, for example, from a trailered boat. In some embodiments, a visual indicator may indicate whether the safety is on, or the buoy has been loaded or launched. In some embodiments, a deployed-buoy location system may record the location coordinates of one (Continued)

or more deployed marker buoys. In an exemplary embodiment, marker buoys may be loaded automatically from a magazine each time a marker buoy is deployed. In some embodiments, marker-buoys may advantageously be deployed by a boater whose hands are otherwise occupied.

20 Claims, 22 Drawing Sheets

(56) References Cited

U.S. PATENT DOCUMENTS 4,126,907 A * 11/1978 Fish ..... B63B 22/10 43/25
4,690,650 A * 9/1987 Bell ..... B63C 9/01 441/40
4,702,715 A * 10/1987 Winick ..... B63C 9/08 441/30
4,834,685 A * 5/1989 St-Onge ..... F42B 4/26 441/13
5,007,029 A * 4/1991 Scott ..... B63B 22/06 114/293
5,195,688 A * 3/1993 Clemmons ..... B63B 22/08 242/470
6,585,133 B1 * 7/2003 Brouwer ..... G01C 15/02 221/270
7,311,575 B1 * 12/2007 Briles ..... A01K 93/02 441/13
7,824,238 B1 * 11/2010 Winter ..... B63B 22/08 441/126
9,277,739 B1 * 3/2016 Barnett ..... A01K 93/02
2004/0208499 A1 * 10/2004 Grober ..... B63B 22/24 396/428
2010/0107959 A1 * 5/2010 Israel ..... B63B 22/003 114/312
2013/0239937 A1 * 9/2013 Macri ..... B63C 9/22 124/56

* cited by examiner

MARKER-BUOY DEPLOYMENT SYSTEM

This application claims the benefit of U.S. Provisional Application Ser. No. 62/032,153, titled "Marker-Buoy Deployment System," filed by De Kock, et al., on Aug. 1, 2014. The entirety of the foregoing application is incorporated herein by reference.

TECHNICAL FIELD

Various embodiments relate generally to anchored marker buoys for marking a location in a body of water.

BACKGROUND

Buoys are used to mark a location in a body of water. Locations are marked for a variety of reasons. Fishermen may deploy buoys to mark a location where the fish are biting. Fisherman may mark a location where the lake bottom topography seems likely to attract fish, for example. Buoys may be used to mark hazards for boats navigating a lake. For example, a shallow region in a lake may be marked by buoys surrounding the shallow region. A large boulder projecting just beneath a surface of a lake may be marked by a buoy. Buoys are used to mark a circumference of a swimming regions. Lifeguards, may be stationed so as to be able to rescue swimmers swimming in the marked swimming region. Swimmers may know the extent of the lifeguarded region. Rescue teams may mark a perimeter of a search area. For example, the location of a capsized water craft may be marked with a buoy, and a corresponding perimeter may be marked to set up a search grid.

Buoys may be fixed in a location by being tethered to an anchor. For example, a buoy may be connected to a chain or a rope, which in turn may connect to an anchor resting on a bottom surface of the body of water. In some embodiments, the length of the tether may be customized to correspond to a depth at a location of deployment.

SUMMARY

Apparatus and associated methods relate to a marker-buoy deployment system having a launching module that becomes armed by inserting a marker buoy, the launching module laterally launches a loaded marker buoy in response to a release device. In an illustrative embodiment, launching module may be spring operated. In some embodiments, the release device may be foot operated. In an exemplary embodiment, a safety device may prevent an accidental launch, for example, from a trailered boat. In some embodiments, a visual indicator may indicate whether the safety is on or off, or if a buoy has been launched. In some embodiments, a deployed-buoy location system may record the location coordinates of one or more deployed marker buoys. In an exemplary embodiment, marker buoys may be loaded automatically from a magazine each time a marker buoy is deployed. In some embodiments, marker-buoys may advantageously be deployed by a boater whose hands are otherwise occupied.

Various embodiments may achieve one or more advantages. For example, some embodiments may permit rapid deployment of a marker buoy. In some embodiments, a marker buoy may be deployed by operation of a foot pedal even when a person's hands are occupied. In some embodiments, marker buoys may be deployed in a consistent fashion. For example, marker buoys, when deployed, may land in the water at a consistent distance from the boat. Users may predictably know where a marker buoy will be deployed, for example. In some embodiments, locations of deployed marker buoys may be recorded. Retrieving deployed marker buoys may be facilitated by the recorded coordinates of the deployed buoys, for example. In some embodiments, deploying a marker buoy may automatically chamber another marker buoy for subsequent deployment. In some embodiments, an aiming device may facilitate precise positioning of deployed marker buoys.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary scenario in which a marker buoy deployment system may be used is briefly introduced with reference to FIG. 1. Second, with reference to FIGS. 2-5, details of an exemplary marker buoy deployment system (MBDS) will be described. Then, exemplary boat locations in which marker buoy deployment systems may be attached are disclosed, with reference to FIG. 6. This is followed by a discussion of a block diagram of an exemplary buoy deployment system which interfaces with a GPS system and/or a fish finder, with reference to FIG. 7. Then a deployment trajectory is described, with reference to FIG. 8. With reference to FIGS. 9-10, exemplary embodiments of system-deployable marker buoys are described. Finally, additional embodiments of MBDS that employ power launched and kick deployment are described with reference to FIGS. 11A-14B.

Figure 1:
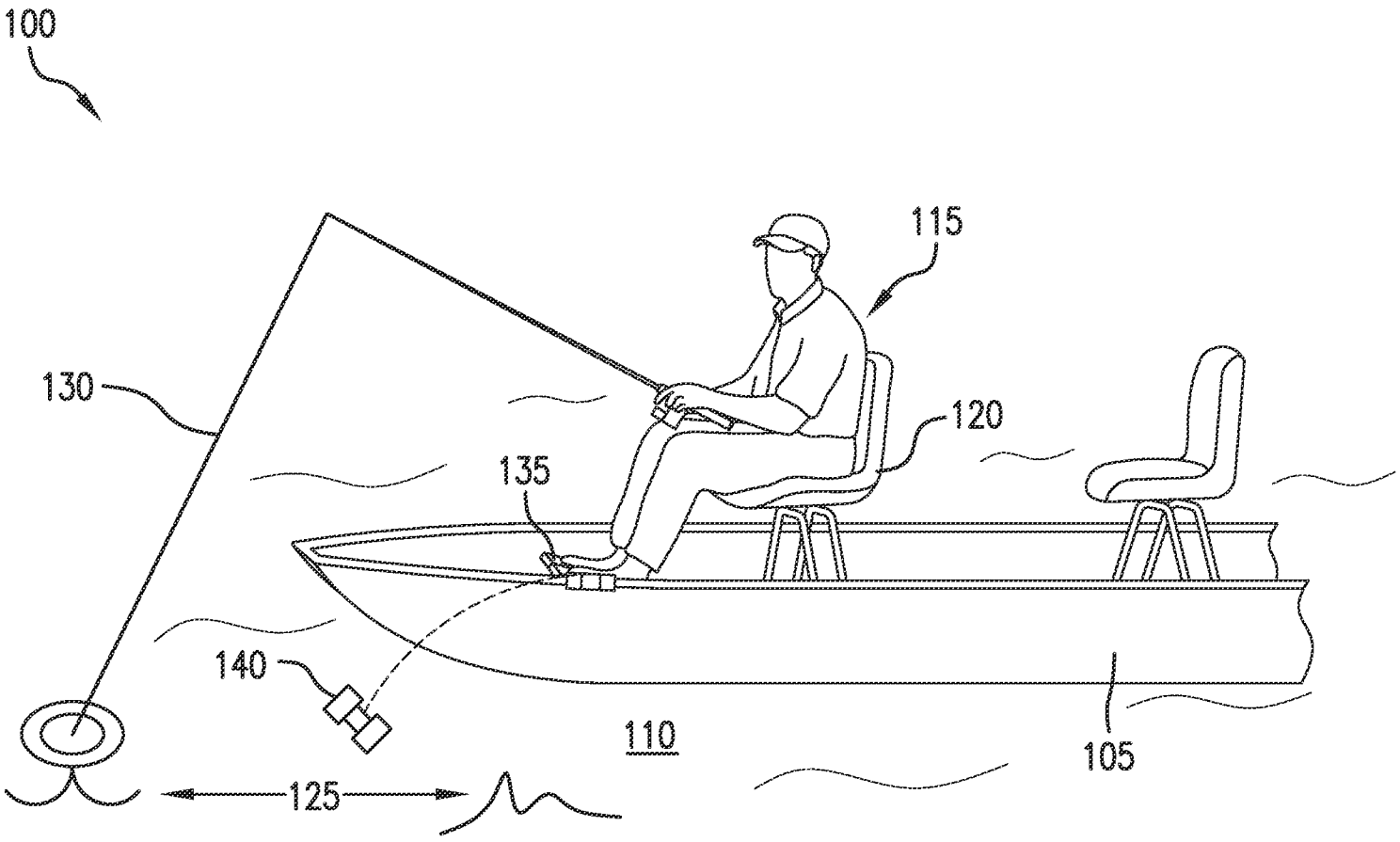
FIG. 1 depicts a scenario in which an exemplary marker buoy deployment system is being used.

FIG. 1 depicts a scenario in which an exemplary marker buoy deployment system is being used. In FIG. 1, an exemplary fishing scenario 100 includes a fishing boat 105 on a lake 110. A fisherman 115 is seated on a captain's chair 120 in the boat 105 that is rocking on waves 125. The fisherman 115 has cast a line 130 into the lake 110. At the foot of the fisherman 115 is a marker buoy deployment system 135. A fish (not depicted) may have just taken the bait on the end of the fishing line 130. And the fisherman 115 has deployed a marker buoy 140 to mark the location where he has found some fish action under the waves 125. To deploy the marker buoy 140, the fisherman 115 has stepped on a foot actuated release device 145. The marker buoy 140 may have an anchor which may descend to a floor of the lake 110 when the marker buoy 140 is deployed. The maker buoy 140 may have a brightly colored floating member which may be visible to a boater from a distance. In some embodiments, the marker buoy 140 may be of a darker color or camouflaged so as to conceal a secret location of which the user does not wish to be made public. For example, a fisherman in a fishing contest may wish to mark a good fishing spot, but not wish it to be made known to the other contestants. In some embodiments, the marker buoy 140 may become visible only when a boat is nearby, for example. The marker buoy may advantageously be deployed readily by a user whose hands are busily occupied trying to land a fish or operate a boat, for example.

Figure 2:
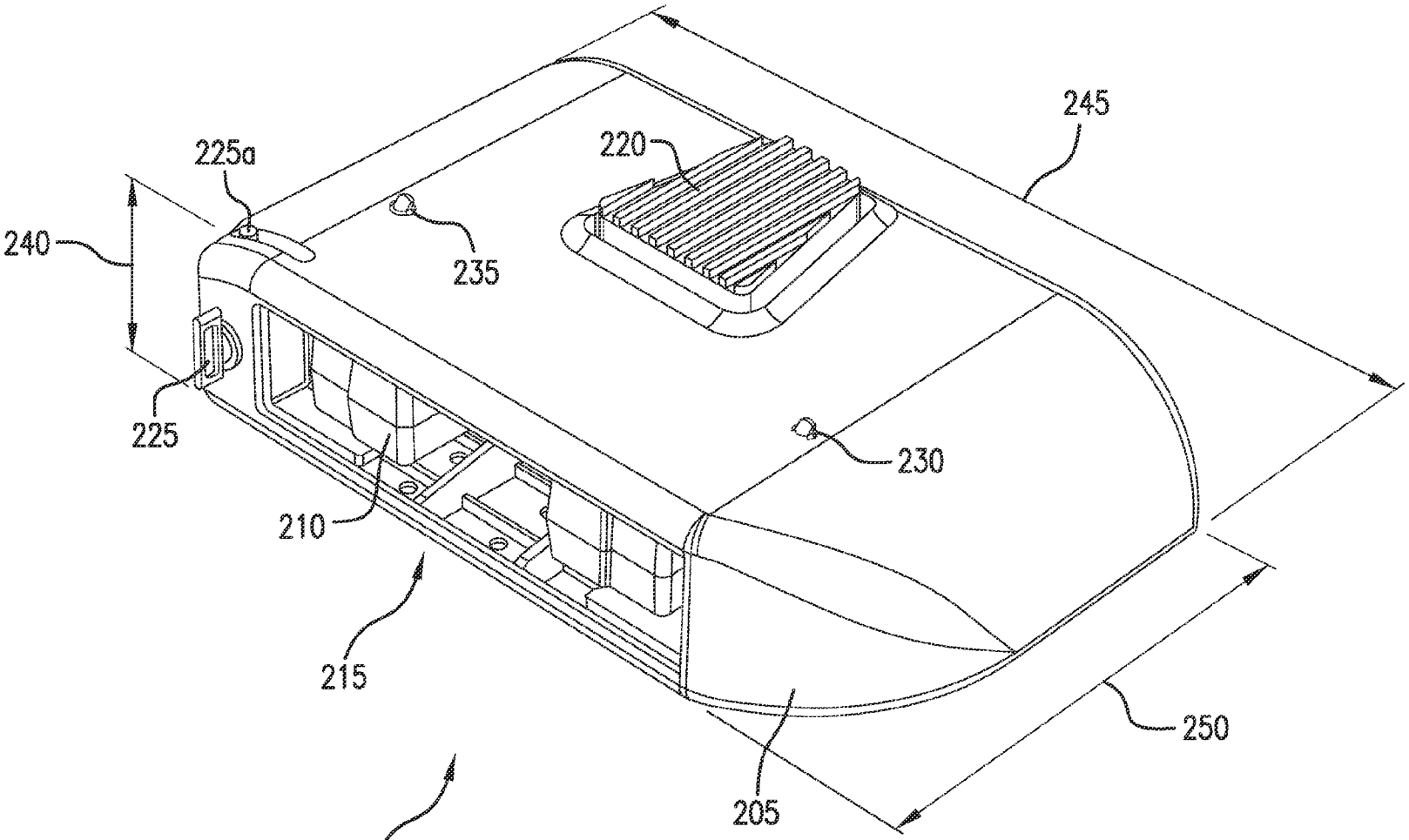
FIG. 2 depicts a perspective view of an exemplary marker buoy deployment system having a loaded marker buoy.

FIG. 2 depicts a perspective view of an exemplary marker buoy deployment system having a loaded marker buoy. In FIG. 2, an exemplary marker buoy deployment system 200 includes an exemplary launching module 205 and an exemplary launchable marker buoy 210. The launchable marker buoy 210 is depicted in a loaded position within a deployment chamber 215 in the launching module 205. The launching module 205 is configured to be positioned on an exterior rail portion of a boat with the deployment chamber 215 lake facing or exterior facing. When the launchable marker buoy 210 is launched, the launchable marker buoy 210 is forced out of the deployment chamber 215 and may land in the water some lateral distance away from the boat. The launchable marker buoy may be launched, for example, by depressing a foot operated launch switch 220.

In some embodiments, the marker buoy deployment system may launch the buoy so as to land ten feet away from the side of the boat, for example. In some embodiments, the buoy may a predetermined distance away from the boat, such as, for example (3, 4, 6, 8, 11, 14, 16, 19, 20, or any other reasonable distance). In an exemplary embodiment, the marker buoy deployment system may have a distance adjustment module. The distance adjustment module may be manually operated in some embodiments. In an exemplary embodiment, the distance adjustment module may be controlled by an electronic signal.

In some embodiments, a safety mechanism 225 may selectively place the marker buoy deployment system in a safe mode. For example, in the depicted figure, a safety mechanism 225 may be actuated by a user to place the marker buoy deployment system in a safe mode. In some embodiments, the safety mechanism 225 may selectively enable or disable deployment of a loaded marker buoy. For example, when the safety mechanism 225 is in a safe mode, operation of the foot operated launch switch 220 may be inhibited. In some embodiments, the marker buoy 210 may be prevented from escaping the deployment chamber 215, when in a safe mode. And when the safety mechanism 225 is in a launch mode, activation of the foot operated launch switch may cause the marker buoy 210 to launch from the launching module 205. The position of a safety mechanism indicator 225*a* indicates whether the safety mechanism 225 is in the safe mode or the launch mode. The illumination may be made with multiple colors to indicate different status. For example, the illumination may be used to whether the buoy is loaded in the device, or has been launched into the water. The indicator 225*a* is depicted in this example as an arm member coupled to a rotatable control dial of the safety mechanism 225, such that the indicator 225*a* is visible by an operator when the dial is in a first position (e.g., armed and unlocked), and not visible by the operator when the dial is in a second position (e.g., safe mode). In the depicted embodiment, status indicators 230, 235 may indicate the status of the marker buoy deployment system 200. For example, the status indicator 230 may illuminate to indicate that a marker buoy 210 is loaded within the deployment chamber 215. In some embodiments, the status indicator 235 may illuminate to indicate whether the safety mechanism 225 is in a safe mode or in a launch mode. In various embodiments, the indicators 230, 235 may illuminate with two or more colors or modulation patterns to indicate a status of the launching module 205, and/or the mode (e.g., safe mode, launch mode), for example. In some embodiments, the indicators 230, 235 may further be operable to indicate whether the buoy is loaded or has been launched from the launching module 205.

The depicted launching module 205 is shown having a vertical height 240, a length dimension 245 and a depth dimension 250. The dimensions 240, 245, 250 may be sized to minimize obstruction on a water vessel. For example, for rail mounted launching modules 205, the depth dimension 250 may be sized to correspond with a lateral dimension of the rail. For example, if a lateral rail dimension of a particular boat is six inches, the launching module may have a depth dimension 250 of six inches or less. In some embodiments, the vertical height 240 may be less than three inches. The vertical height 240 may be sized so as not to present a tripping hazard to a boater. In some embodiments, the vertical height 240 may be less than 2.5 inches. In an exemplary embodiment, the vertical height 240 may be less than 2 inches. The length dimension 245 may be sized to minimize a floor space occupied by the launching module 205. The launching module 205 may be configured so as to support the weight of a human body. For example, if a user were to stand on top of the launching module 205, the launching module 205 may support the user without damage to the launching module 205.

Figure 3:
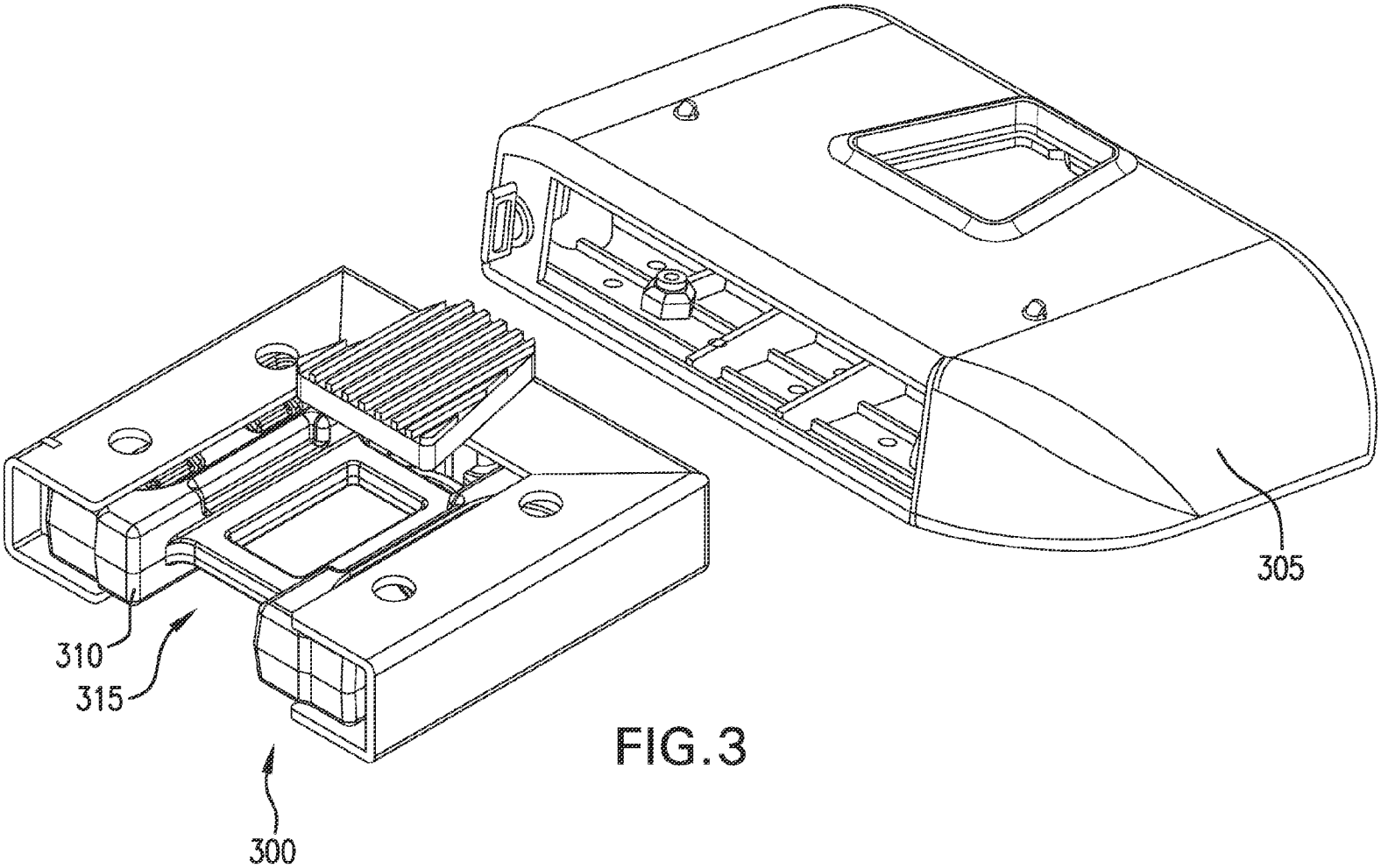
FIG. 3 depicts a perspective view of an exemplary spring-loaded launching system separated from a marker buoy deployment system.

FIG. 3 depicts a perspective view of an exemplary spring-loaded launching system separated from a marker buoy deployment system. In FIG. 3, an exemplary launching mechanism 300 is shown removed from a housing 305. The launching mechanism 300 has received a marker buoy 310 within a deployment chamber 315. A foot actuated launch switch 320 is coupled to the launching mechanism 300. The deployment chamber 315 is sized to correspond to a specific marker buoy 310.

Figure 4:
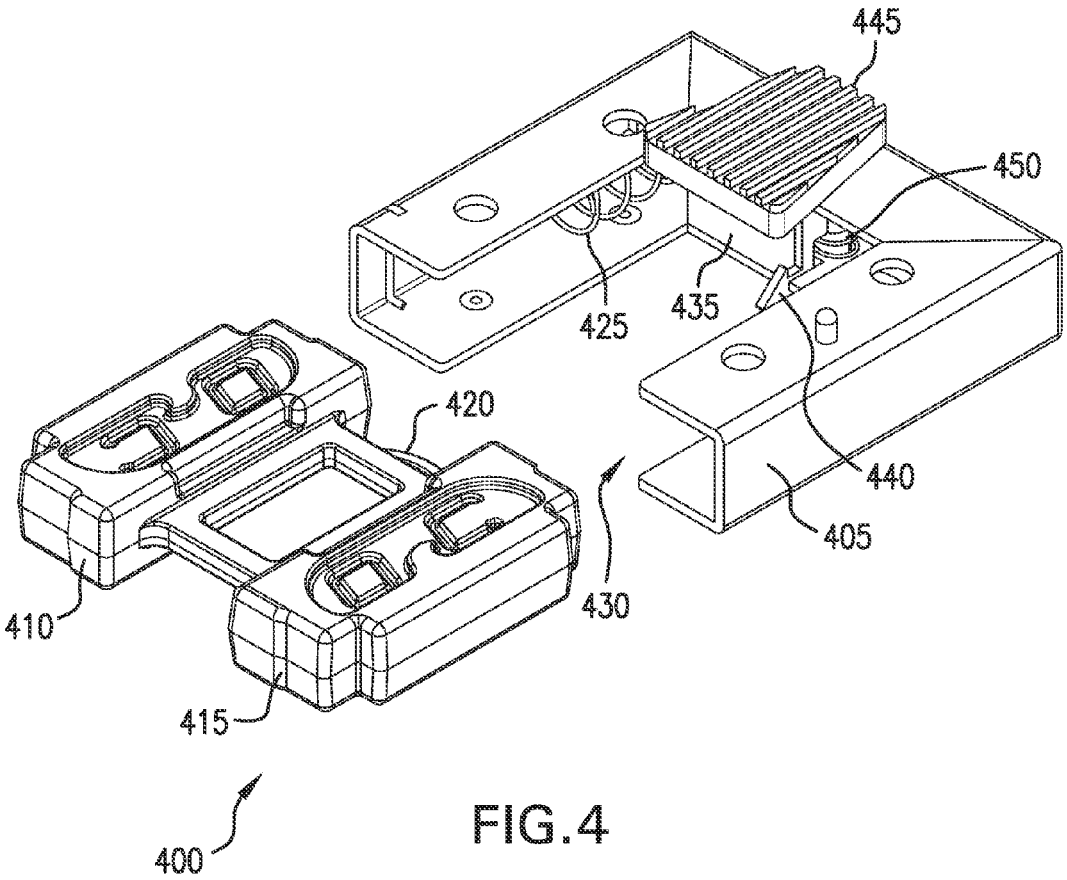
FIG. 4 depicts a close-up perspective view of an exemplary spring-loaded launching system and marker buoy.

FIG. 4 depicts a close-up perspective view of an exemplary spring-loaded launching system and marker buoy. In FIG. 4, an exemplary marker buoy 400 is shown next to an exemplary launching mechanism 405. The depicted buoy 400 is an H-type of marker buoy. The H-type marker buoy 400 has to buoyant ends 410, 415. A center connecting section 420 connects the two buoyant ends 410, 415. A cord may connect the buoy 400 to a heavy weight which may serve as an anchor. The cord may be wound about the center connecting section 420 which has a reduced vertical dimension as compared with the buoyant ends 410, 415. When launched, the weight of the anchor may pull the cord, which may in turn flip the marker buoy 400 upon the water as the cord unwraps. When the anchor settles on the bottom of the lake, for example, the marker buoy may stop flipping and may retain the remainder of the cord still wound about the center connecting section 420.

The depicted launching mechanism 405 has a spring 425 which may be compressed when the marker buoy 400 is inserted into a deployment chamber 430. The spring may be compressed between the buoyant end 410 and a back wall surface of the launching mechanism 405. Another spring (not depicted) may be compressed between the other buoyant end 415 and the back wall surface of the launching mechanism 405. A buoy catch 440 may retain a buoy that has been loaded into the launching mechanism 405. The buoy catch 440 may catch a complementary feature on the buoy 400 thereby retaining the buoy 400 in the deployment cavity 430. In some embodiments, a buoy catch 440 may be designed to catch the anchor and/or line attached to the buoy 400, for example.

The buoy 400 may be released from the buoy catch 440 by a release mechanism 445. In the depicted embodiment, the release mechanism 445 is a foot-depressed button. In some embodiments, a hand lever may release the buoy 400 from the buoy catch 440. In some embodiments, the buoy may be remotely released from the buoy catch 440. For example, an electric solenoid may retain and/or release the buoy 400 from the buoy catch 440. The electric solenoid may be operated by an electric switch, for example. In some embodiments, a remote control may be user operated to control the release and or capture of a buoy 400. For example a wireless key fob may have a button that, when depressed, may release the buoy 400 from the buoy catch 400. When released, the spring 425 (and perhaps another spring, if present) may launch the buoy 400 from the launch mechanism 405. A launch spring 450 may return the buoy catch 440 to a catch position when the foot-activated deployment pedal 445 is no longer depressed.

Figure 5:
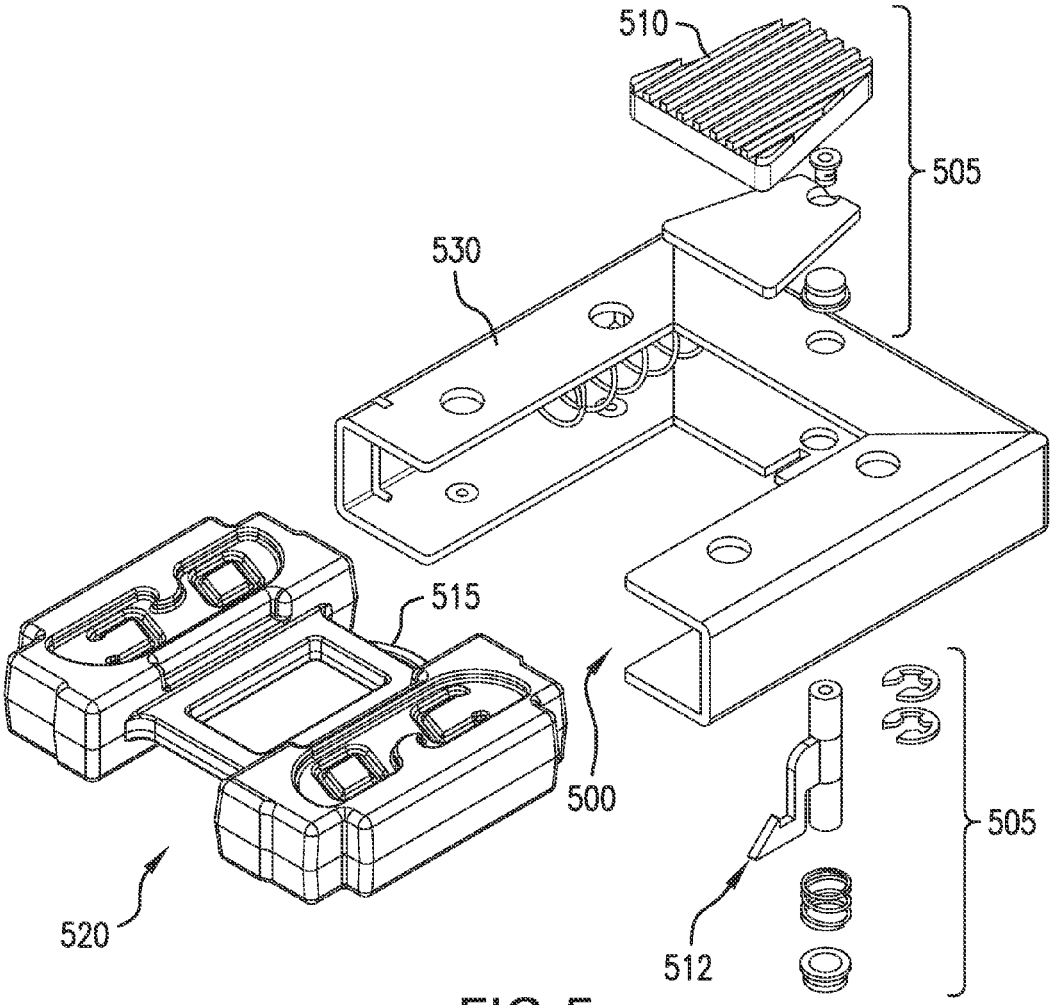
FIG. 5 depicts an exploded perspective view of an exemplary spring-loaded marker buoy launching system.

FIG. 5 depicts an exploded perspective view of an exemplary spring-loaded marker buoy launching system. In FIG. 5, various components of the launch mechanism 500 are detailed. For example, a buoy release subsystem 505 includes a release control in the form of a foot pedal 510. The buoy release subsystem also includes a buoy catch 512 configured to releasably attach to a corresponding catch feature 515 on a marker buoy 520. A return spring ensures that the buoy catch 510 is in a positon to secure a buoy 520 when the foot pedal 510 is not depressed. The buoy release subsystem is vertically slidable with respect to a buoy capture housing 530.

Figure 6:
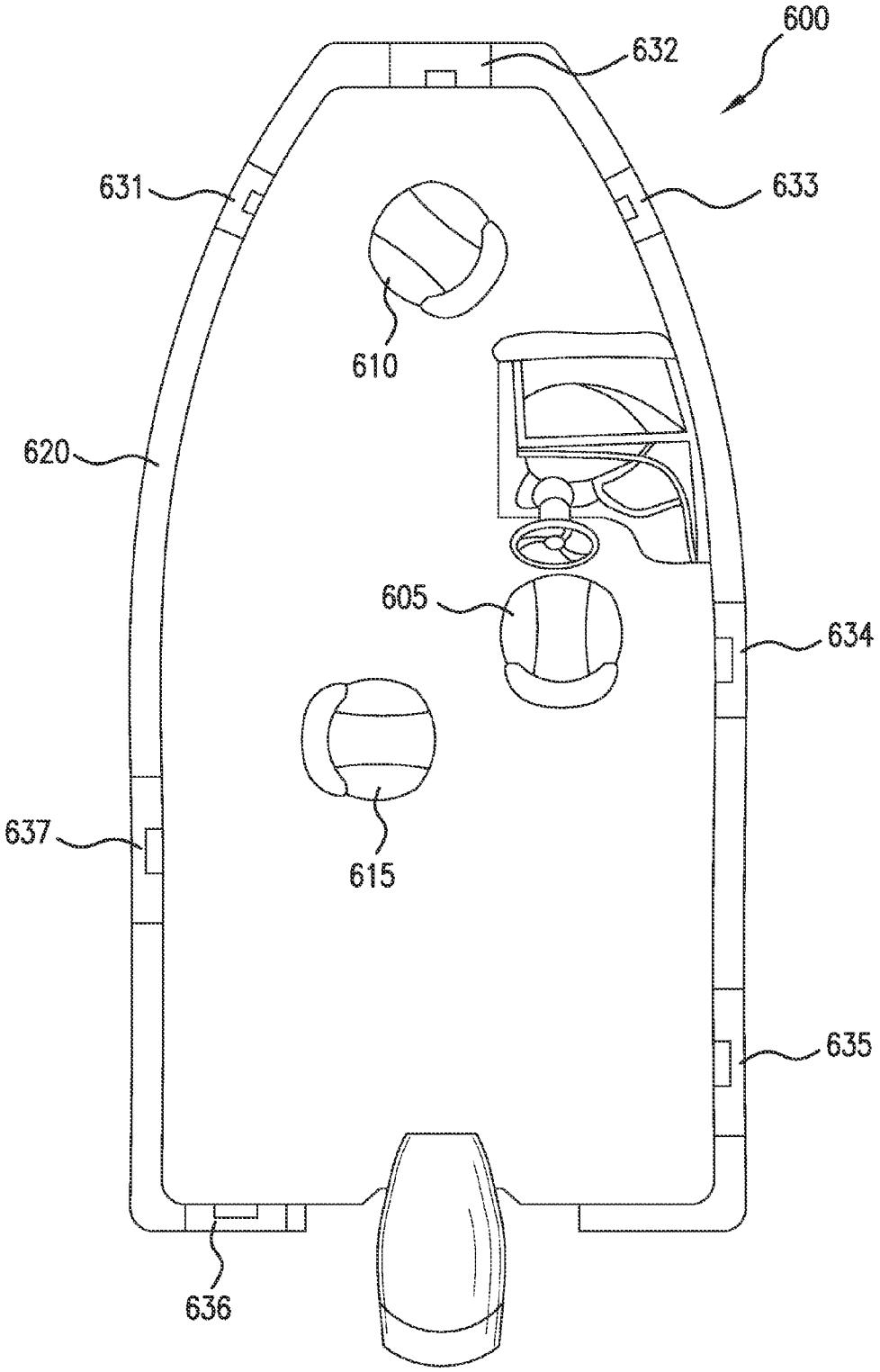
FIG. 6 depicts a plan view of an exemplary fishing boat with a number of marker buoy deployment systems located around a periphery of the boat.

FIG. 6 depicts a plan view of an exemplary fishing boat with a number of marker buoy deployment systems located around a periphery of the boat. In FIG. 6, a boat 600 includes a driver's seat 605 and two captain's seats 610, 615. Around much of a periphery of the boat 600 is an exterior rail portion 620. At various locations along the exterior rail portion 620 are marker buoy deployment systems 631, 632, 633, 634, 635, 636, 637. Each of the deployment systems 631, 632, 633, 634, 635, 636, 637 may launch a marker buoy into a lake away substantially perpendicular to the boat surface, for example. In some embodiments the launch direction may not be substantially perpendicular to a boat surface. For example, in some embodiments, a buoy may be launched with a positive elevation so as to launch the buoy a greater distance than a launch directed parallel to a water surface. In some embodiments, a negative elevation direction may be used so as to minimize the potential for a buoy to cross a fishing line, for example.

A fisherman sitting in the captain's chair 610 may launch a marker buoy in one of three directions. For example, the deployment systems 631, 632, 633 each may be within the reach of a fisherman's foot, should the fisherman be facing in the direction of the marker buoy 631, 632, 633. A fisherman sitting in the captain's chair 615 may launch a marker buoy in one of three directions. For example, the deployment systems 635, 636, 637 each may be within the reach of a fisherman's foot, should the fisherman be facing in the direction of the marker buoy 635, 635, 637. A boat operator sitting in the driver's seat 605 may operate a deployment system 634. The deployment system 634 may be lever operated, for example.

Figure 7:
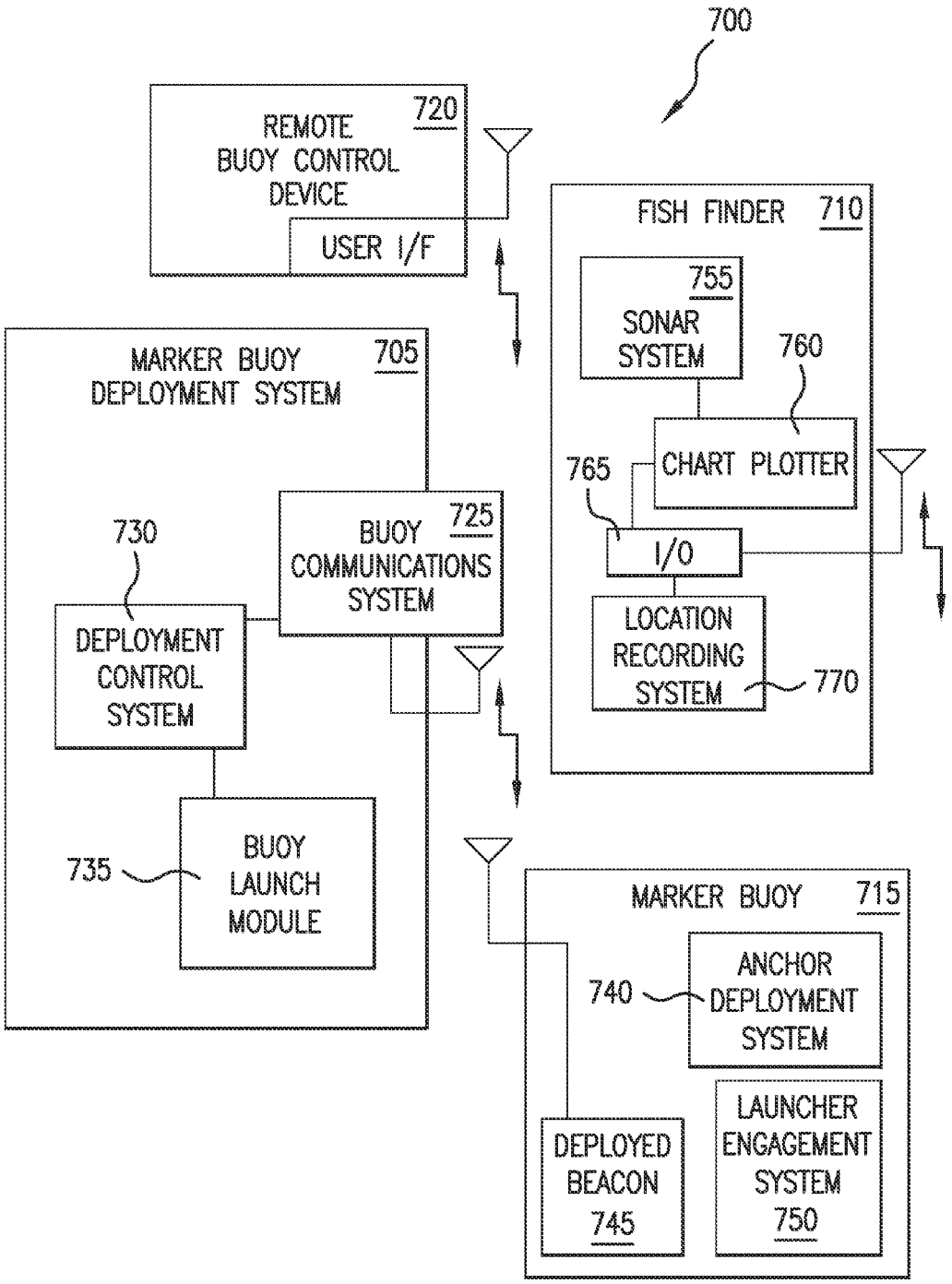
FIG. 7 depicts a block diagram of an exemplary marker buoy deployment system with integrated GPS coordinate deployment locations.

FIG. 7 depicts a block diagram of an exemplary marker buoy deployment system as it interacts with other systems. In FIG. 7, an exemplary block diagram 700 includes a marker buoy deployment system 705, a fish finder 710, a marker buoy 715, and a remote buoy control device 720. The depicted marker buoy deployment system 705 has a buoy communications system 725. The buoy communications system 725 may be configured to communicate with the fish finder 710, for example. The buoy communication system 725 may be configured to communication with the remote buoy control device 720 and/or the marker buoy 715. In some embodiments, the buoy communications system 725 may include a wired communication capability. In an exemplary embodiment, the buoy communication system 725 may include a wireless communication capability. For example, the communication with the remote buoy control device may be via a Bluetooth communication link. In some embodiments, the communication between the buoy communications system 725 and the fish finder 710 may include a wired communication link.

The marker buoy deployment system 705 is shown having a deployment control system 730 and a buoy launch module 735. A marker buoy 715 may be loaded into the buoy launch module 735 before being deployed. The deployment control system 730 may provide a visual indicator that the buoy launch module 735 has received a marker buoy 715. The buoy communications system 725 may receive a signal indicative of a user input launch request from the remote buoy control device 720. The buoy communication system may respond to the received launch request signal by sending a corresponding signal to the deployment control system 730. The deployment control system 730 may activate a solenoid in the buoy launch module 735 which may cause the marker buoy 715 to be deployed.

The marker buoy 715 may have an anchor deployment system 740, that when deployed facilitates a tethered anchor to find a sea floor. The marker buoy 715 may have a deployed beacon 745. The deployed beacon may broadcast a beacon signal when the marker buoy is deployed. The beacon signal may be received by the buoy communications system 725. The beacon may communicate to the marker buoy deployment system 705 a status of the marker buoy. For example, the beacon may communicate that the marker buoy 705 has been deployed. In some embodiments, the beacon may communicate an anchor depth and/or GPS coordinates of the marker buoy 715. The marker buoy 715 has a launcher engagement system 750, which may engage the buoy launch module 735, for example.

The exemplary fish finder 710 has a sonar system 755, a chart plotter 760, an I/O interface 765 and a location recording system 770. In some embodiments, the sonar system 755 may identify a sea floor and/or a location of fish. The chart plotter 760 may include a GPS positioning system, for example. In some embodiments, the location recording system 770 may record the locations that a boat has travelled. The boat locations may have time stamped data associated with them. The I/O interface 765, may receive buoy deployment signals from the buoy communications system 725, when a marker buoy 15 is deployed, for example. The location recording system 770 may record the boat location associated with the deployed marker buoy 715. In some embodiments, the remote buoy control device 720 may receive user input in the form of a foot pedal switch, fob-style actuator, or a hand-activated lever or button, for example. In some implementations, the signals from such a device 720 may be received by the location recording system 770, and may cause a waypoint to be recorded on the location recording system 770 and/or plotted on the chart plotter 760, for example. Recording waypoints in this manner may be performed with or without operation of or presence of the marker buoy deployment system 705.

Figure 8:
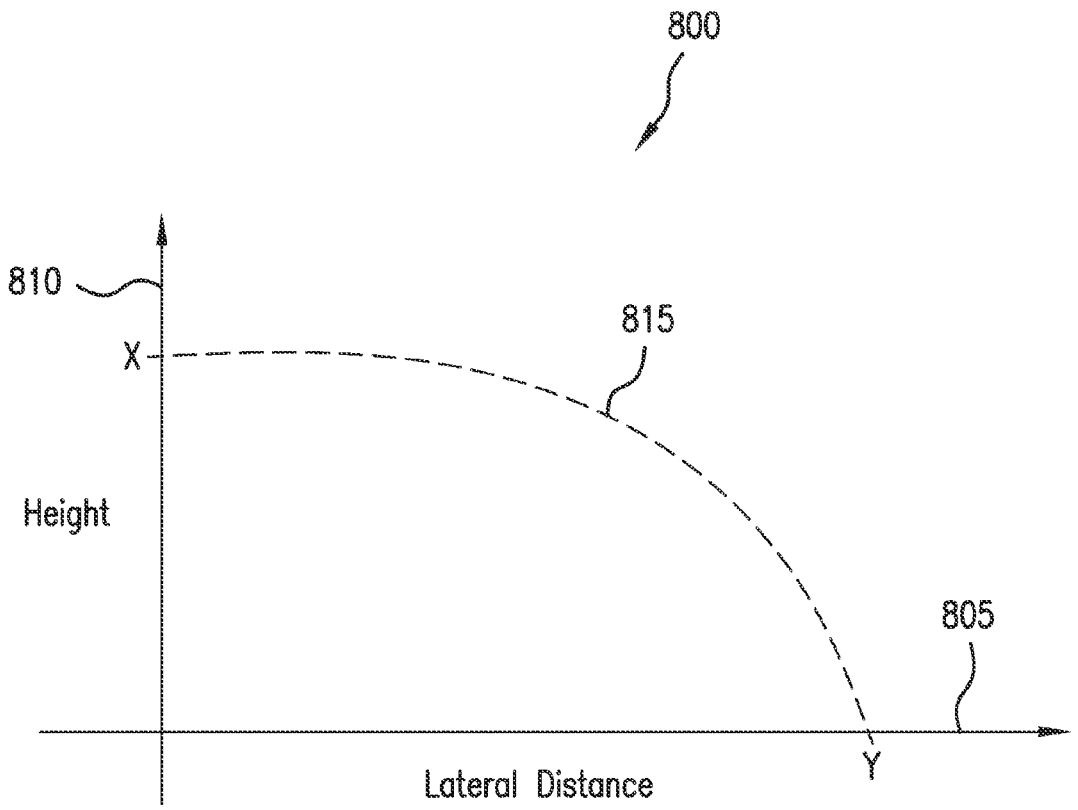
FIG. 8 depicts an exemplary graph showing an exemplary launch trajectory of a deployed marker buoy from a marker buoy deployment system.
Figure 9:
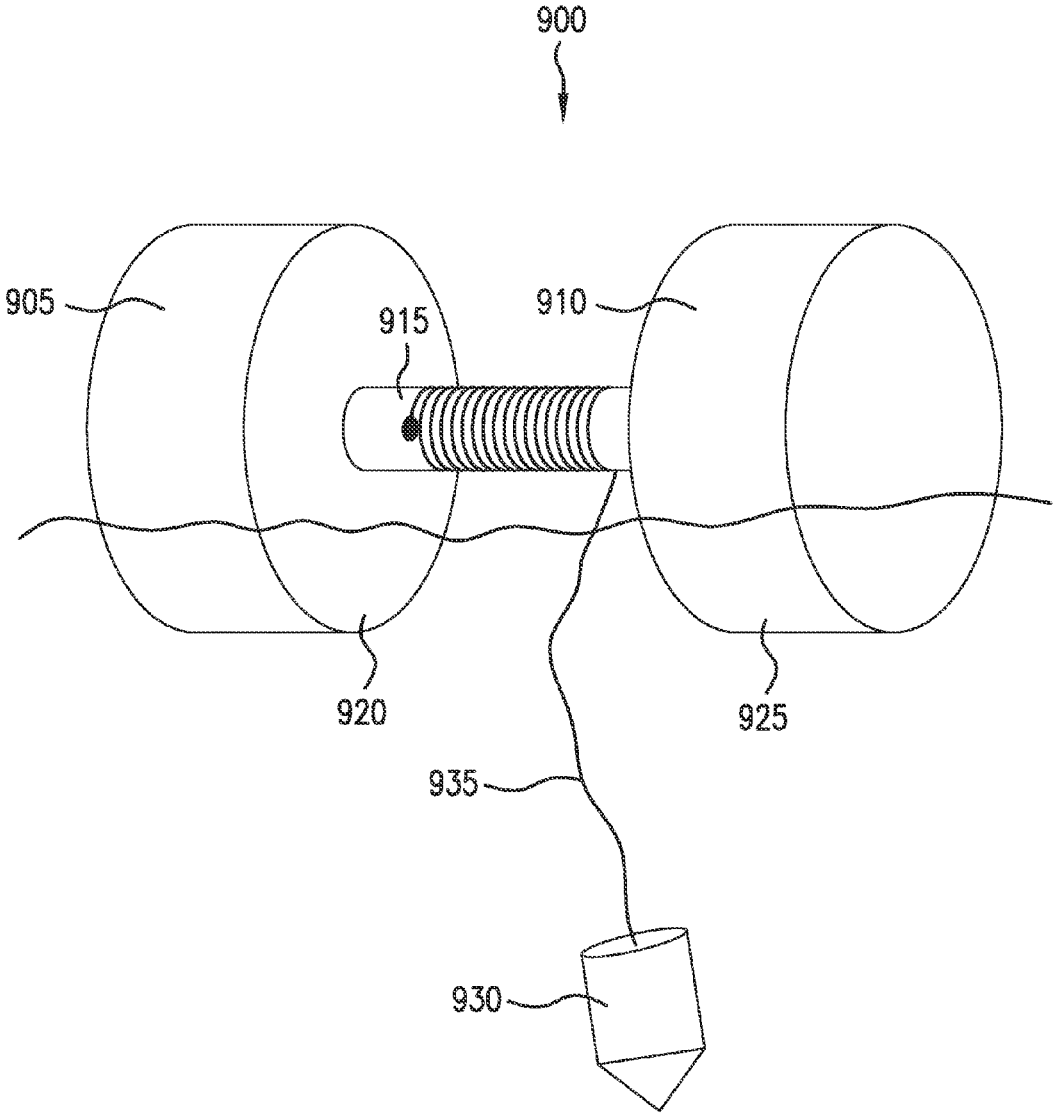
FIG. 9 depicts a perspective view of an exemplary weighted cylindrically symmetric buoy.

FIG. 8 depicts an exemplary graph showing an exemplary launch trajectory of a deployed marker buoy from a marker buoy deployment system. In FIG. 8, an exemplary graph 800 has a horizontal axis 805 which represents a lateral deployment distance. The graph 800 has a vertical axis 810 which represents a vertical height. The graph 800 depicts a trajectory 815 of a marker buoy during deployment. Before deployment, the marker buoy is within a deployment device on a boat some X distance above the water. After deployment, the buoy will be floating on the surface of the water some Y distance from the side of the boat.

FIG. 9 depicts a perspective view of an exemplary weighted cylindrically symmetric buoy. In FIG. 9, a cylindrically symmetric buoy 900 is shown. The exemplary buoy 900 is shaped like a dumbbell. The buoy has two buoyant ends 905, 910 and a connecting rod 915. Each of the buoyant ends 905, 910 may have a weighted portion 920, 925. The weighted portions 920, 925 may inhibit the rotation of the buoy 900 after an anchor 930 has reached the sea floor. Use of a cylindrically symmetric buoy may facilitate the automatic winding of a cord 935 by an exemplary buoy launching system. For example, the buoy 900 may be inserted into a launch chamber before winding the cord 935 about a connecting rod 915. The launch chamber may then rotate the buoy 900 thereby winding the cord 935 about the connecting rod 915. The launch chamber may stop rotating the buoy 900 the anchor is retained within the launch chamber, for example.

Figure 10A:
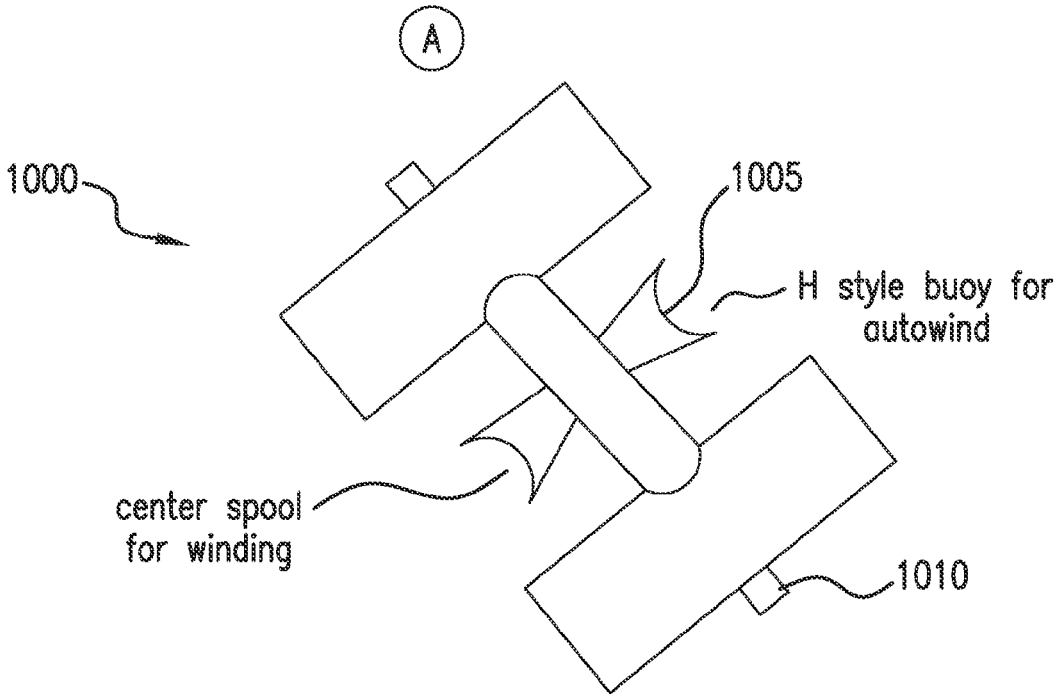
FIGS. 10A-10B depicts a perspective view of an exemplary deployment buoy having a ratcheting anchor spool.
Figure 10B:
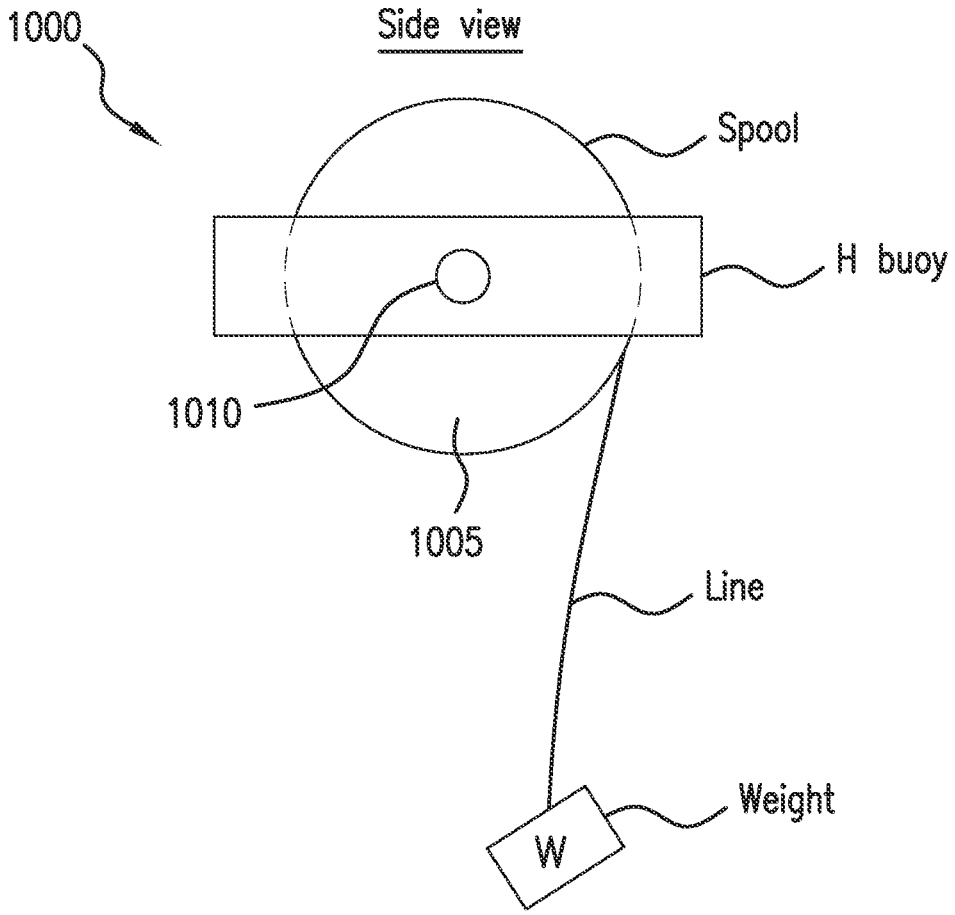

FIGS. 10A-10B depict a perspective view of an exemplary deployment buoy having a ratcheting anchor spool. In FIG. 10, an H-type marker buoy 1000 includes an anchor line spool 1005. The anchor line spool 1005 has a rotatable shaft 1010 which is coupled to two floatation members 1015 of the H-buoy 1000. The anchor line spool 1005 may have a ratchet mechanism (not depicted) that may permit the anchor line spool 1005 to rotate in one direction only with respect to the floatation members 1015. For example, when deployed, an anchor line 1020 may have been spooled onto the anchor line spool 1005 in one direction (e.g., clockwise or counterclockwise from some perspective). The ratchet may not permit the spool to rotate in the direction that would permit an anchor 1025 to find the sea floor, for example. In response to gravity, the H-type marker buoy 1000 may flip over and over to permit the anchor line 1020 to unwind as the anchor's weight causes the anchor 1025 to descend. Then, when the H-type marker buoy 1000 is retrieved and engaged with a launch deployment device, a respooling system may rotate the anchor line spool 1005 so as to respool the anchor line 1020. The ratchet may permit the anchor line 1020 to be respooled by permitting the rotation of the anchor line spool in the respooling direction, for example.

Figure 11A:
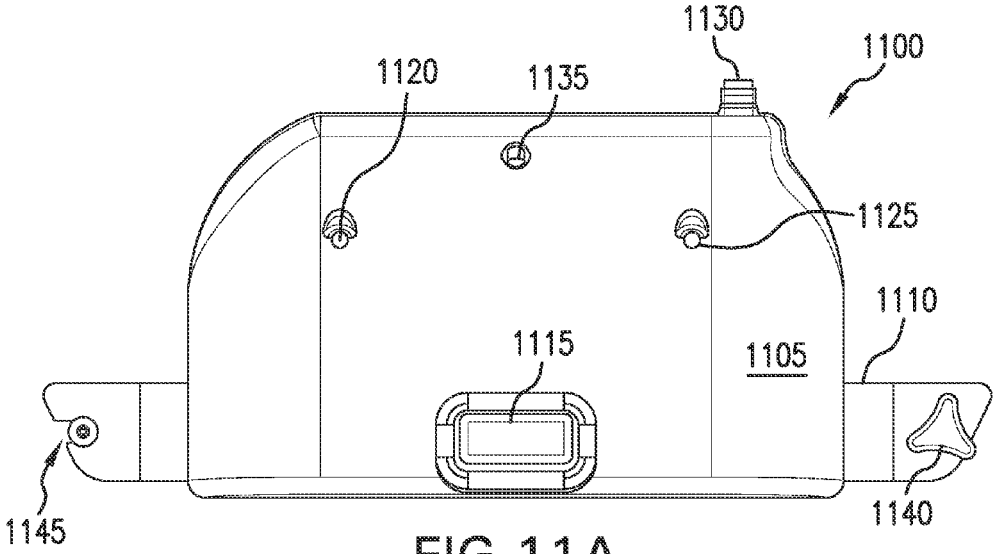
FIGS. 11A-13D depict exploded assembly views showing construction of an exemplary marker buoy deployment system.

FIGS. 11A-13D depict exploded assembly views showing construction of an exemplary marker buoy deployment system. In FIGS. 11A-B, top and front elevation views depict an exemplary MBDS 1100 includes a housing 1105 coupled to a mounting module 1110 for mounting on a compatible mounting point system. The housing 1105 includes a manual launch control 1115, illuminating indicators 1120 and 1125, a switch 1130, and a tab 1135. The switch 1130 may control power state for the electronics in the MBDS 1100. For example, the switch 1130 may disable power to the indicators 1120, 1125 to conserve battery power when not needed.

The tab 1135 may releasably engage a safety strap (not shown) that may stretch from underneath the housing 1105 to prevent, when engaged on the tab 1135, the buoy from being launched out of the MBDS 1100. In some examples, the safety strap may be an elastic shock type cord that hooks onto the tab 1135 at its distal end, and rigidly attaches to the bottom of the housing 1105, thereby stretching across the launch aperture window. When the operator is ready to launch, the shock cord may be disengaged from the tab 1135, and allowed to retract itself toward the bottom of the housing 1105.

The mounting bracket 1110 provides a quick connect and disconnect of the MBDS 1100, for example, to permit travelling or towing, or for storage, to prevent damage, for example. To attach the mounting bracket 1110, a receiver notch 1145 is engaged under the head of a mounting boss, while a coupler 1140 is securely engaged to a mating connector. In some examples, the coupler 1140 may be threaded to engage corresponding threads in the mating connector. Other securement coupler arrangements may be appreciated by those of ordinary skill in the art of quick disconnect couplers.

Figure 11B:
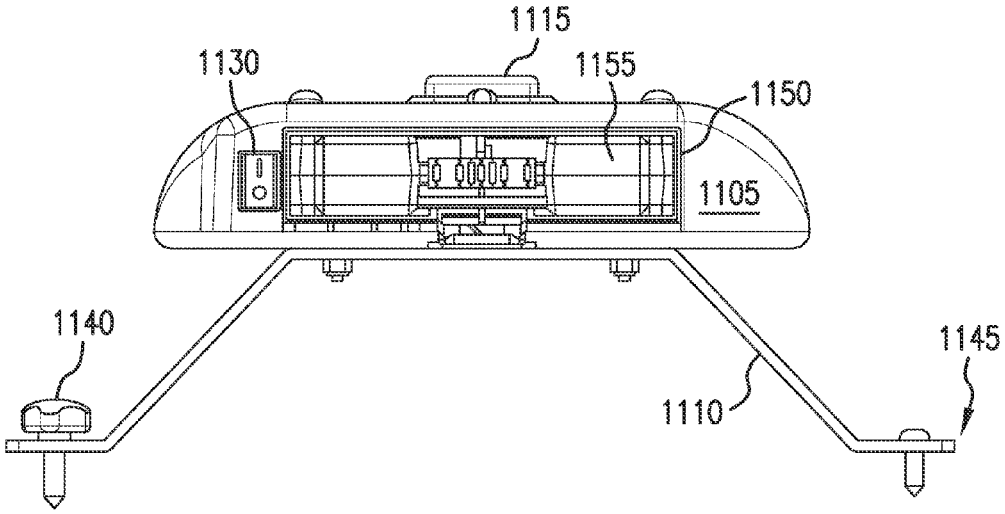

In FIG. 11B, the housing 1105 is seen to include a cassette 1150 loaded with a marker buoy 1155. In the depicted state, the MBDS 1100 would launch the buoy 1155 in response to the user pressing down on the launch control 1115.

Figure 11C:
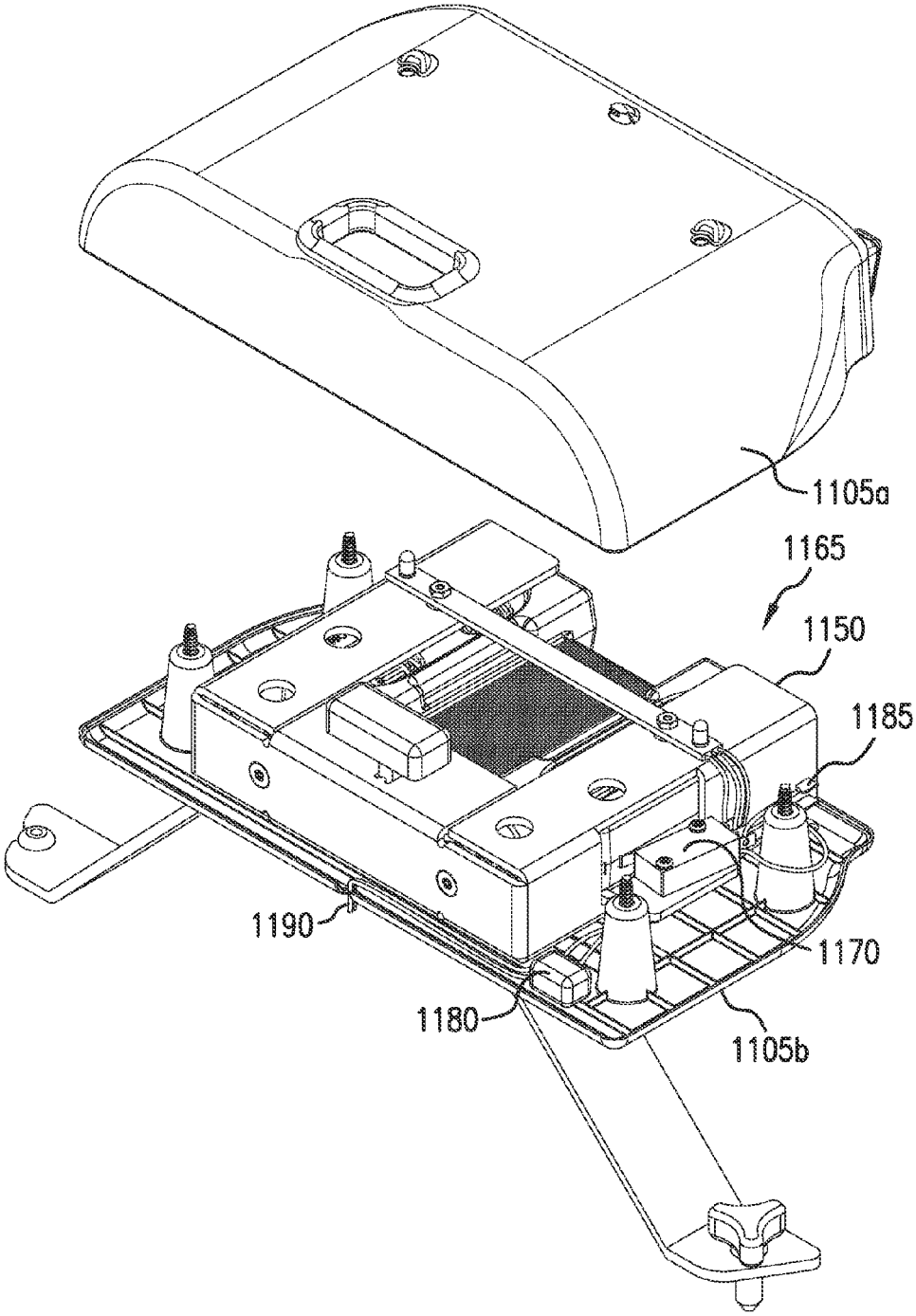

In FIG. 11C, the housing 1105 is disassembled into a top 1105*a* and a bottom 1105*b*. The top 1105*a* serves as a protective shell over a deployment system 1165, which includes the cassette 1150 and a payload control module 1170. The payload control module 1170 is in electrical communication with a port 1180 through which it may communicate and/or receive power. Power may be supplied by, by way of example and not limitation, batteries, external power supplied from the boat's electrical system, or other processor-based devices (e.g., navigation, fish finder, boat computer systems). The payload control module 1170 may include a payload sensor, control the indicators 1120, 1125, and receive input commands from the switch 1130 via electrical contacts 1185. In some embodiments, the payload control module may include a switch that is actuated to be in a first mode when the buoy 1155 is loaded into the cassette 1150, and in a second mode when the buoy 1155 is not loaded into the cassette 1150. In response to the payload control module switch, the indicator 1120 may change color or intensity (e.g., turn on) in response to the cassette 1150 being loaded and armed. In response to the switch 1130, the indicator 1125 in some embodiments, may be turned on or off to indicate the presence of battery power and the power status of the MBDS 1100. In some embodiments, which may be operatively connected as a device on a network or as a slave device reporting to a master controller on the boat, the power status and load status signals may be communicated to a remote device via a link 1190. In the depicted example, the link 1190 includes a set of wires that may be routed, for example, to a remote master controller to pass data and/or control signals to and/or from the MBDS 1100.

Figure 12:
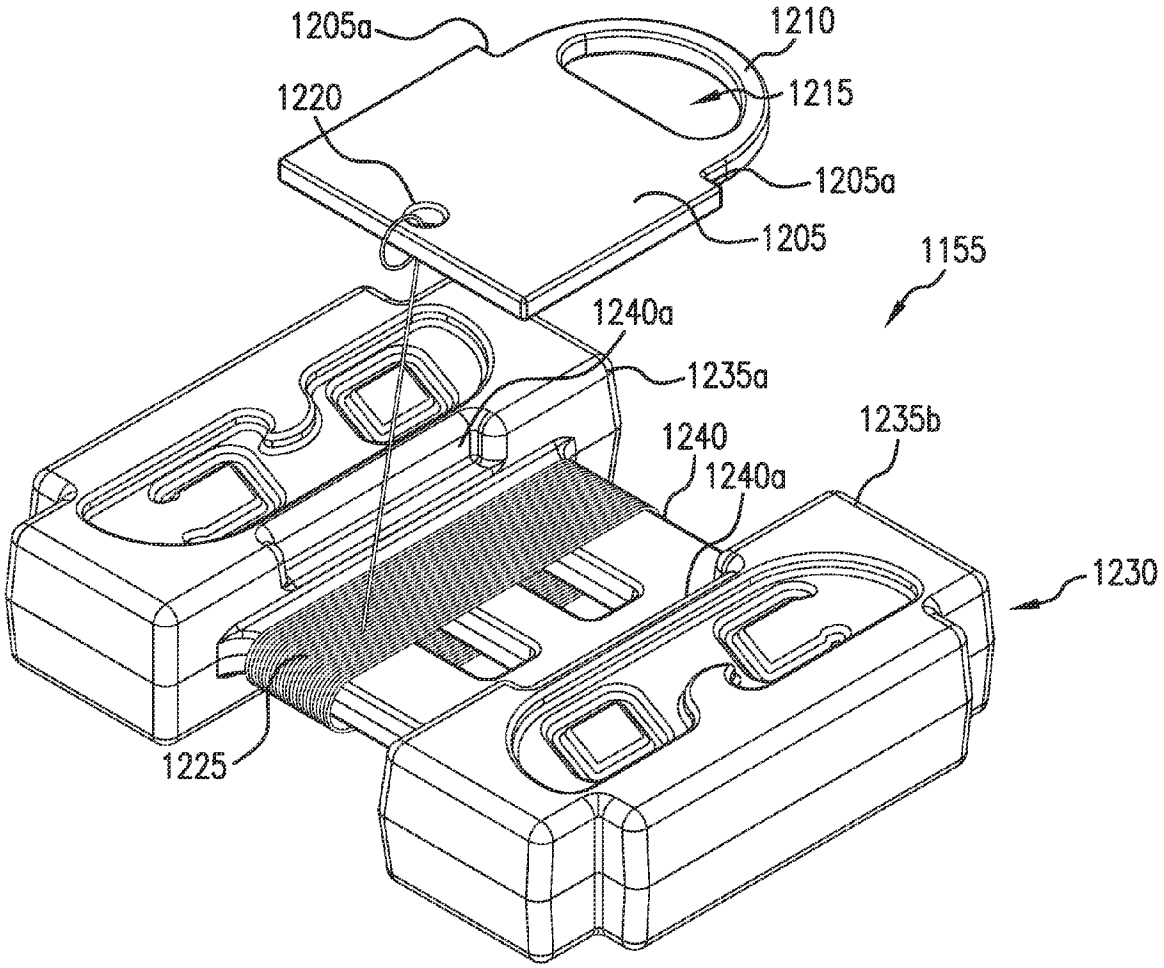

FIG. 12 depicts an exemplary buoy 1155. The buoy 1155 includes a weighted anchor 1205 having a retention member 1210 that defines an aperture 1215 with a body portion generally formed as a plate (e.g., defining two opposing flat substantially parallel major surfaces) separated by a thickness. In the depicted figure, the retention member 1210 intersects a distal side of the body portion, but the retention member 1210 has a lateral dimension that is less than a lateral dimension of the distal side of the body portion, thereby forming a shoulder 1205*a* on exterior corners formed by the junction of the retention member 1210 and the body. The anchor 1205 attaches at a proximal end to a tether 1220. The tether 1220 wraps numerous turns 1225 around a buoy float 1230. The buoy float 1230 includes 2 thicker side members 1235*a,b*, separated by a relatively thin central member 1240. The tether 1220 wraps around the central member 1240 between the side members 1235*a,b*. The distance between the side members 1235*a,b* is widened in a portion to accommodate the body of the anchor 1205. The distance between the side member 1235*a,b* reduces, forming a complement to receive the shoulders 1205*a*.

When the buoy is loaded and armed, the launch module may be biased against the inboard sides of the float side ends 1235*a,b*, while the latch module engages the outboard facing surface of the retention member 1210. The shoulders 1205*a* engage the complementary shoulders 1240*a* to oppose the biasing force applied to the inboard side of the ends 1235*a,b*. When the latch disengages from the outboard edge of the retaining member 1210, the launch module accelerates the side ends 1235*a,b*, and the shoulders apply a corresponding acceleration to the shoulders 1205*a* to accelerate the anchor 1205.

FIGS. 13A-D show assembly views of the cassette 1150 showing further details. In the depicted figure, the cassette 1150 may be formed from a single sheet or plate of metal, or a unified body construction made of plastic. In the case of a metallic construction, the cassette includes opposing side channels 1305*a,b*, separated by central channel 1310. The channels 1305*a, b*, 1310 may be formed from a single metallic sheet or plate by cutting and bending operations, as may be appreciated by one of ordinary skill in the art. The channels 1305*a, b*, 1310 are substantially each individually formed as a U-channel or C-channel.

Figure 13A:
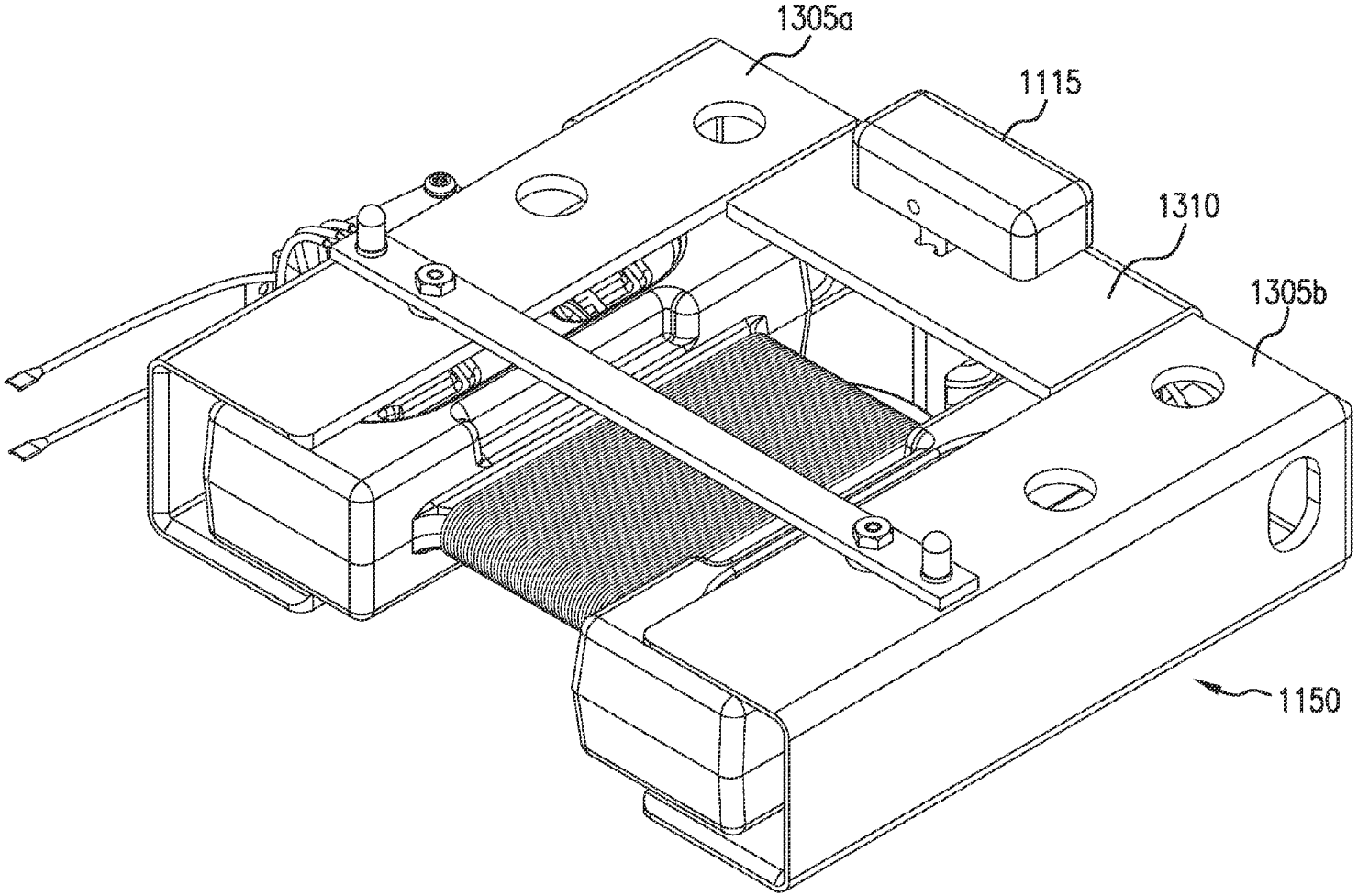
Figure 13B:
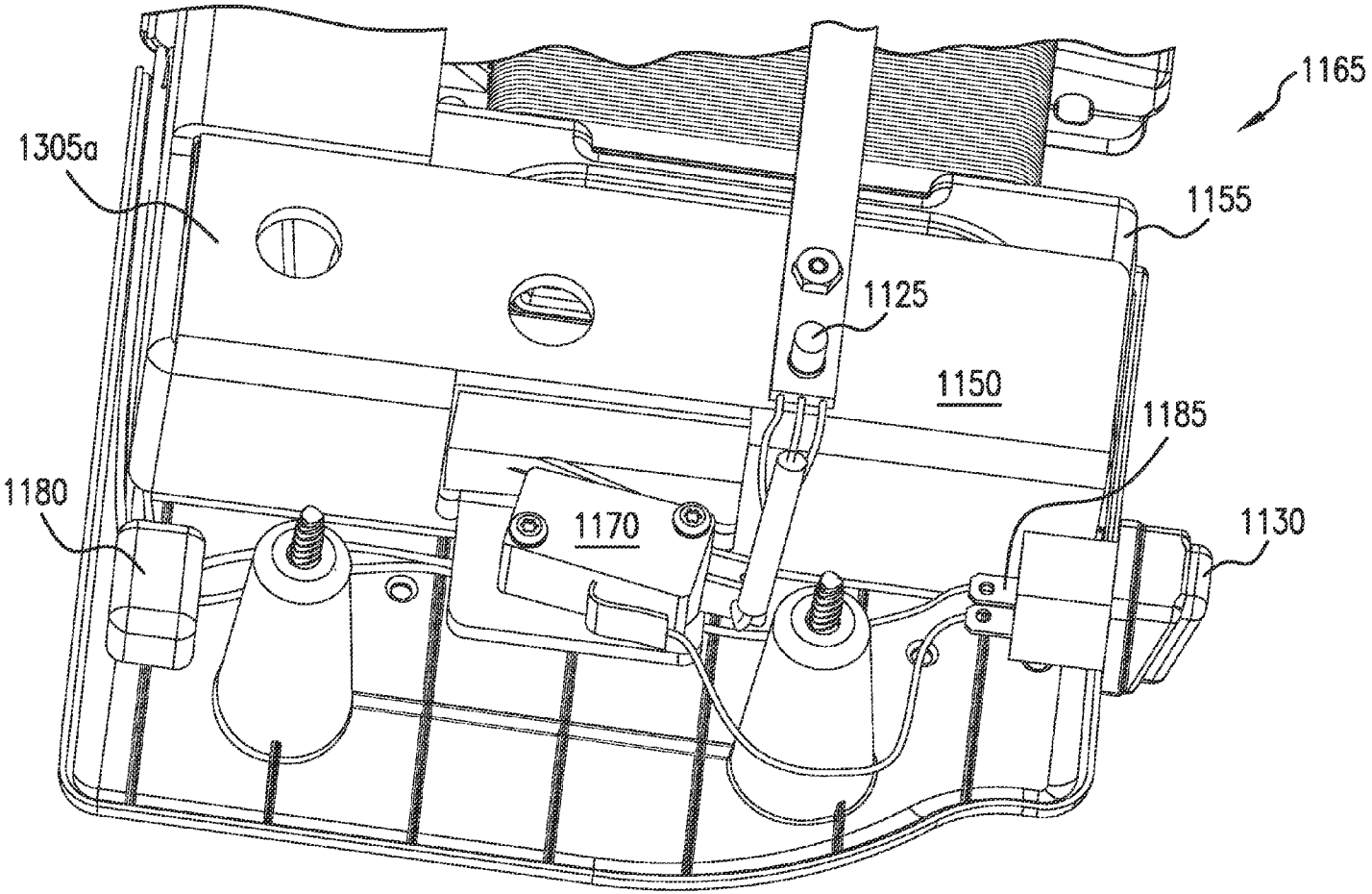
Figure 13C:
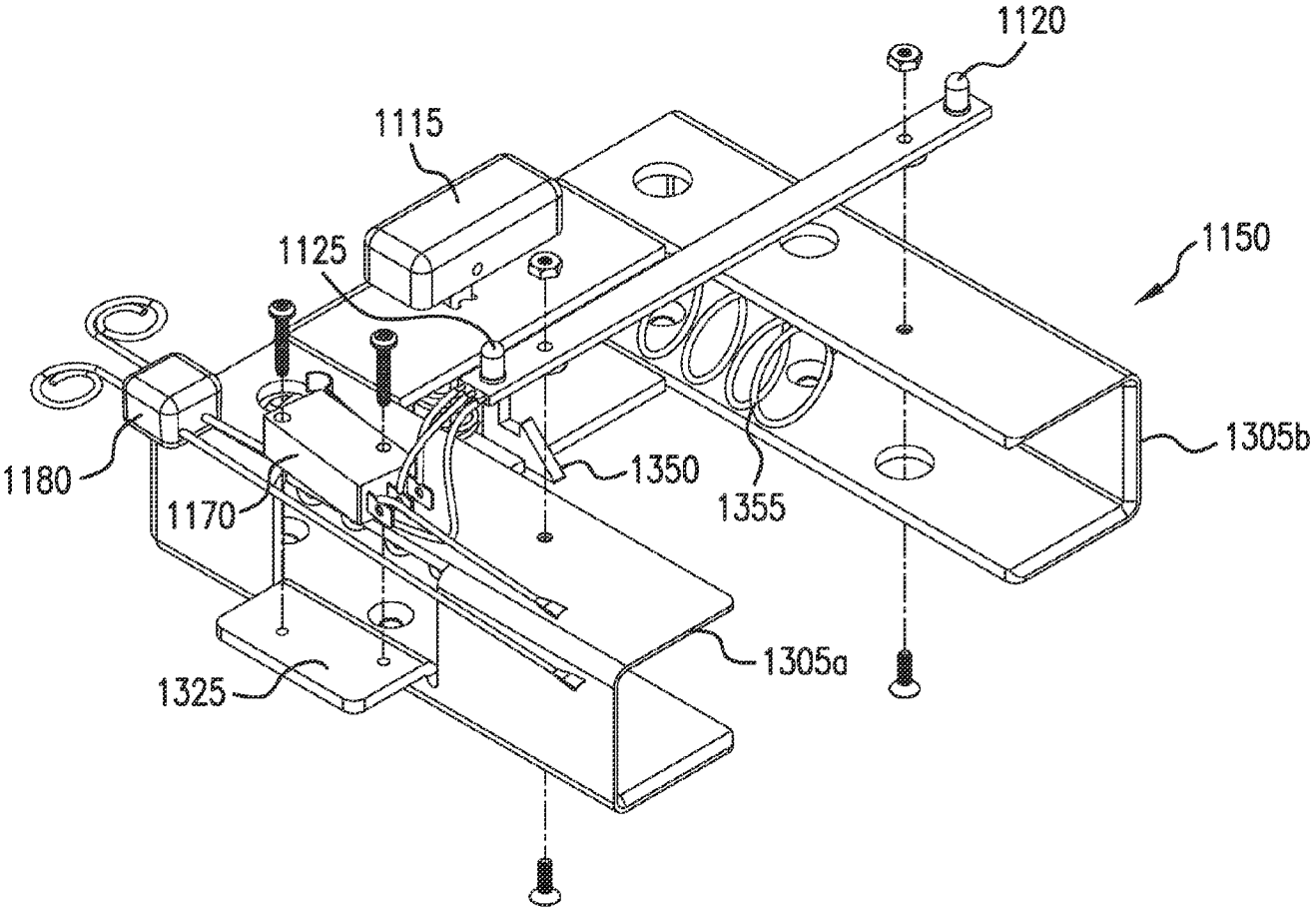

FIGS. 13B-C depict a shelf 1325 formed by bending a portion of the channel 1305*a* to support portions of the payload control module 1170. In the depicted example, the payload control module 1170 has a sensor switch that extends through the aperture formed by bending the shelf 1325, so that that presence of the payload (e.g., marker buoy 1155) in the cassette 1150 can be detected.

Figure 13D:
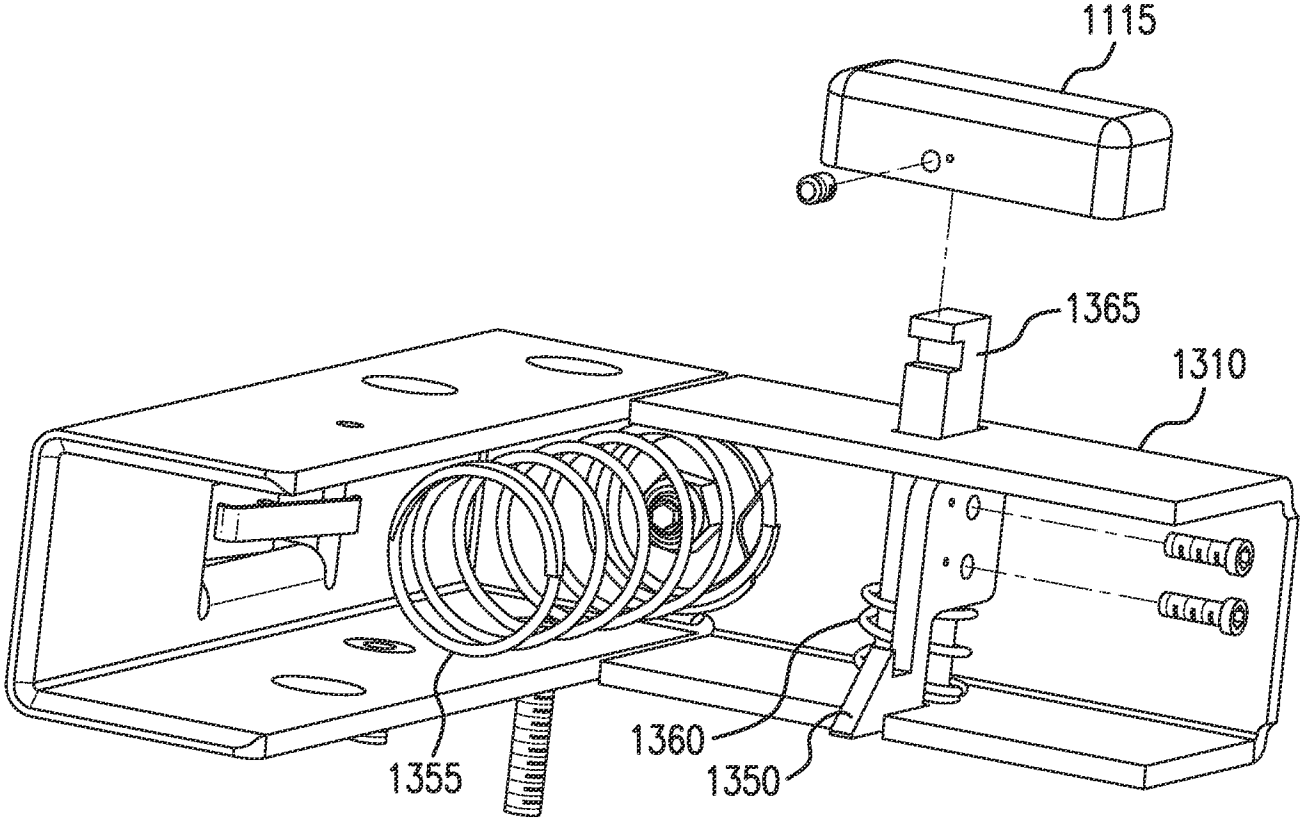

FIG. 13D depicts a partial perspective detail inside the cassette 1150. The cassette 1150 includes a launch mechanism hook 1350 that engages the outboard edge of the buoy retaining member 1210 when the buoy 1155 is loaded and armed in the cassette 1150 of the MBDS 1100. When the operator pushes down on the control 1115, the hook 1350 moves down and slides away from engagement with the buoy retaining member 1210. When that happens, the springs 1355 in each of the channels 1305*a,b* can release from their compressed state and eject the buoy 1155 from the cassette 1150. Of course, the buoy cannot eject if the safety strap is still engaged with the tab 1135, or another safety mechanism blocks the launch. After the operator releases the control 1115, a spring 1360 oriented in a biasing arrangement around a drive member 1365 that extends through a wall of the channel 1310 and between the user control 1115 and the hook 1350, may raise the control 1115 upward. In the depicted figure, a pair of screws secure the hook 1350 to a side of the drive member 1365. In some embodiments, the hook 1350 and drive member 1365 may be integrally formed as a unitary body construction, an example of which is described with reference to FIG. 5.

In some embodiments, the drive member 1365 may be operatively automatically controlled by a motor or other actuator. The automatic actuator may employ gears, cams, and/or threaded engagement, for example.

Figure 14A:
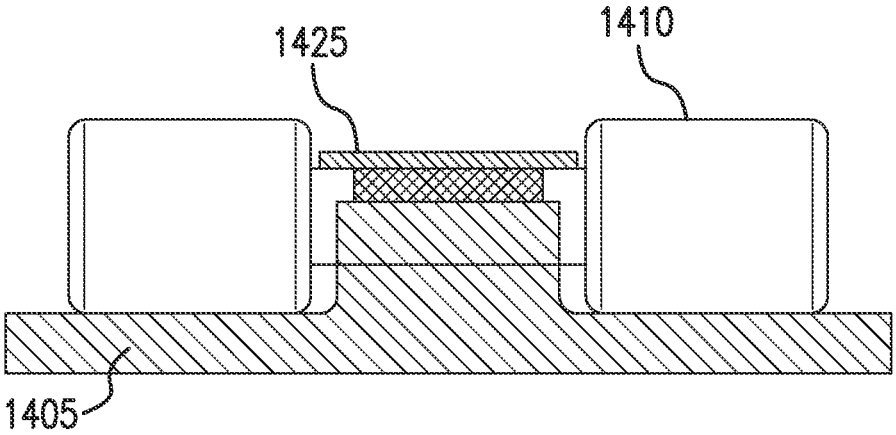
FIGS. 14A-14B depict plan and top views of an exemplary kick deployable marker buoy deployment system.
Figure 14B:
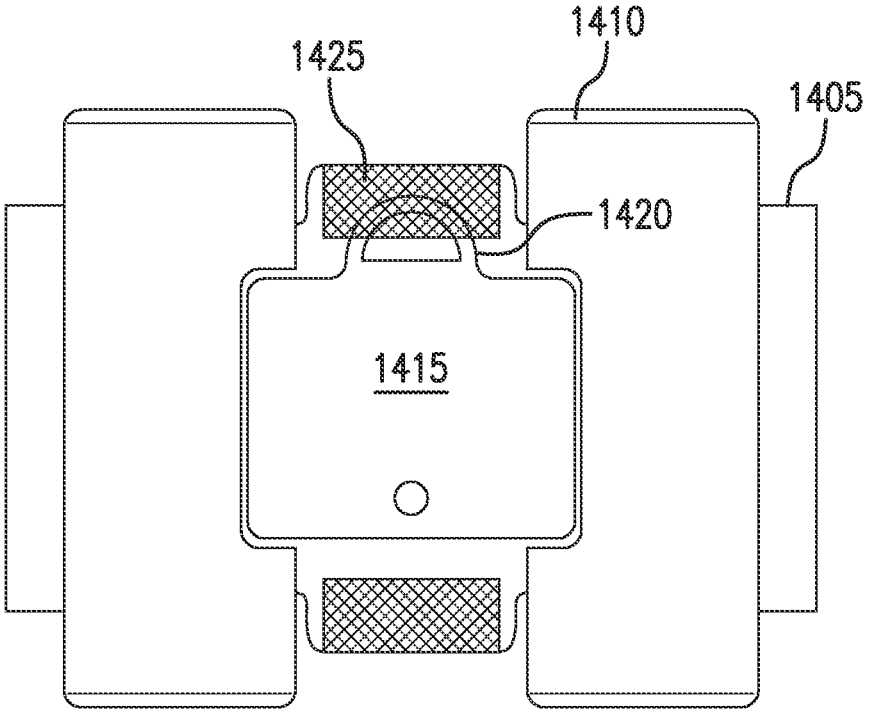

FIGS. 14A-14B depict plan and top views of an exemplary kick deployable marker buoy deployment system. In the depicted figure, a mount 1405 receives a buoy 1410 with a coiled-tether anchor 1415. When installed in the mount 1405, the anchor includes a retaining portion 1420 that is overshadowed by a retention clip 1425. The retention clip 1425 substantially prevents the buoy 1410 from disengaging vertically from the mount 1405.

The mount 1405 may include magnetic field generator (e.g., permanent magnet, electromagnetic solenoid coil) that imparts a reluctance force that resists vertical separation of the buoy 1110 from the mount 1105. In some examples, the anchor 1415 may have a magnetic permeability substantially greater than 1, such as 2, 3, 4 5, 10, 15, 20, 100, 500 or more.

To deploy the buoy 1410 into the water, the operator simply can kick or shove the buoy laterally away from the retention clip 1425.

FIGS. 15A-15D depict assembly, top crossections, and side cross-sectional views of an exemplary MBDS with an integral buoy winding system. As depicted, a ratcheting style anchor buoy, an example of which is described with reference to FIGS. 10A-10B. In the depicted embodiment, an auto-winding MBDS 1500 includes a buoy 1505 formed with floatation members 1510, a spool 1515, and a shaft 1520. The spool 1515 may be ratcheted to constrain rotation relative to the floatation member 1510 to a preferred direction.

In some examples, the spool 1515 may be rigidly coupled to the shaft 1520, and a ratchet mechanism may couple the shaft 1520 to each of the floatation members 1510. One end of the shaft 1520 includes a coupling member 1525, which may be a gear, for example.

To capture the buoy in a launch cavity of the auto-winding MBDS 1500, a retention member 1530 includes a distal hook 1535 at a distal end of two laterally spaced arm members of the retention member 1530. When the buoy 1505 is inserted into the launch cavity, the distal hooks 1535 engage an outboard facing surface of respective opposing ends of the shaft 1520. When so engaged, the hooks 1535 retain the buoy 1505 in the launch cavity.

Figure 15A:
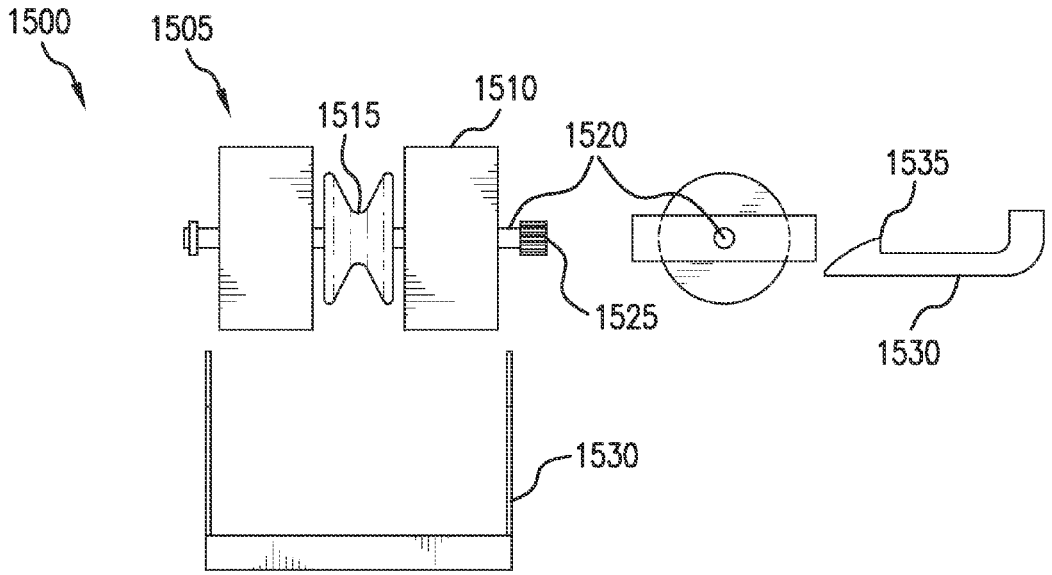
FIGS. 15A-15D depict assembly, top crossections, and side cross-sectional views of an exemplary MBDS with an integral buoy winding system.
Figure 15B:
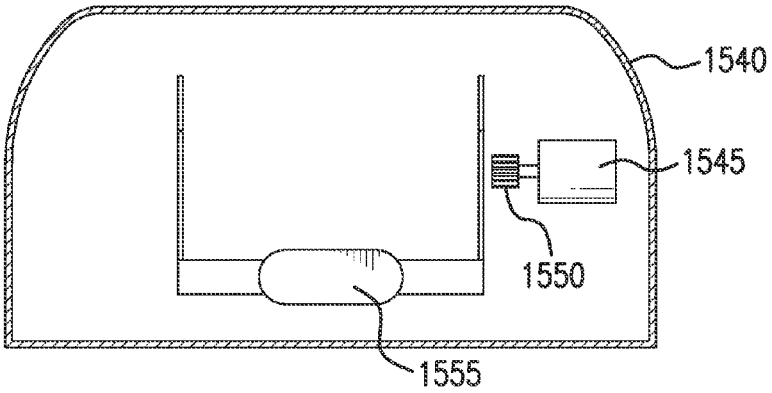

FIG. 15B depicts a launch module 1540, which may define the launch cavity. In some embodiments, the launch module 1540 may be substantially formed as a unitary body of plastic, in which may be formed the launch cavity. In some embodiments, the launch cavity of the launch module 1540 may be constructed to support and contain the buoy 1505 in an orientation that, upon disengagement of the retention member hooks 1535 from the shaft 1520, a propulsion member (e.g., one or more springs under compression) may rapidly accelerate the buoy 1505 and eject it from the launch cavity. In some embodiments, the launch cavity may include rib features, bosses, walls, or the like to make supporting contact with the top, bottom, and/or sides of the floatation members 1510, for example.

The launch module 1540 houses a motor 1545 for providing torque to wind the spool 1515. The motor 1545 has a shaft with a coupler 1550. In some embodiments, the coupling member 1550 may be a gear that engages the gear 1525 of the shaft 1520 when the buoy 1505 is loaded and armed within the launch cavity. In operation, the motor 1545 may be controlled to rotate in response to insertion of the buoy 1505. The coupling member 1550 may engage the coupling member 1525 to transmit torque from the motor 1545 shaft to the shaft 1520, and thereby to the spool 1515.

In some embodiments, the operator may turn off the motor 1545, for example, when the anchor has been fully retracted into the launch cavity. In some embodiments, the motor 1545 may be driven by a drive or supply (not shown) that may be responsive to a signal indicative of the anchor being retracted in proximity or within the launch cavity. By way of example and not limitation, the signal indicative of anchor retraction may include a hall effect sensor, optical sensor, proximity switch, current sensor with threshold detection, or a combination of such techniques.

The launch module 1540 further includes the retention member 1530 coupled to respond to user activation of a control member 1555. In some examples, the control member may be a foot pedal. In some embodiments, the control member 1555 may include a controllable actuator (e.g., solenoid, screw drive), which may be remotely controlled by a control device. When in a default or deactivated state, the control member 1555 is biased in a first position, and the hooks 1535 are biased into a position to engage the outboard surface of the shaft 1520. When activated or in an actuated state, the control member 1555 is biased in a second position, and the hooks 1535 are drawn out of the position to engage the outboard surface of the shaft 1520. In some embodiments, the hooks 1535 are displaced vertically, or orthogonally to the direction of the acceleration vector when the buoy 1505 is ejected from the launch cavity. The hooks 1535 may be displaced in response to actuation of the control member 1555.

Figure 15C:
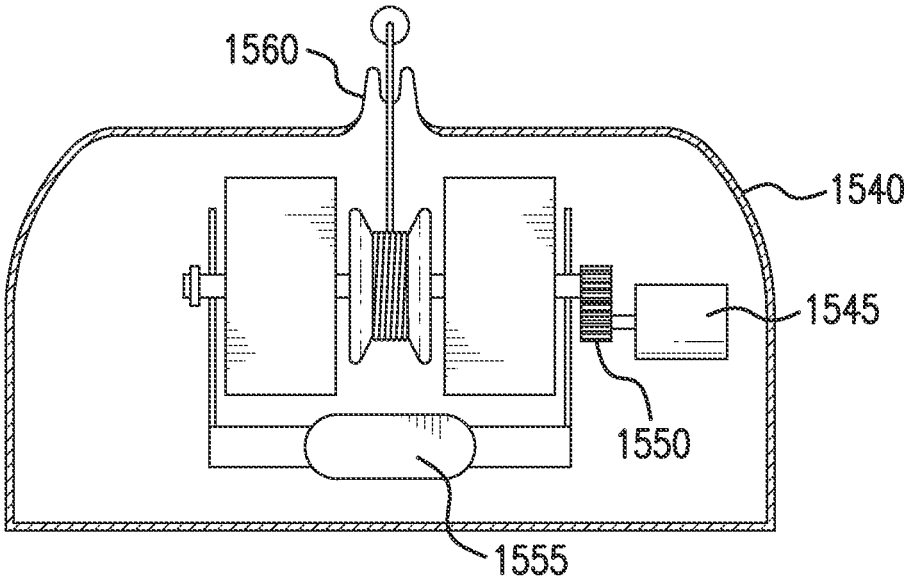
Figure 15D:
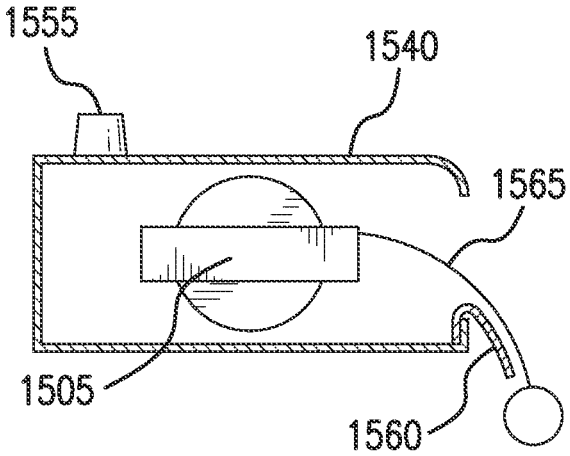

FIGS. 15C-15D depict the launch cavity loaded with the buoy 1505. Extending from an exterior of an outboard facing surface of the launch module 1540 is a line guide 1560. As the spool 1515 winds a line 1565, the line guide 1560 directs the line 1565 onto the spool 1515. This guide 1560 may advantageously prevent fouling the line, or winding the line unevenly on the spool 1515.

In some examples, the coupling members 1525, 1550 may be male/female couplers (e.g., hex socket, hex driver). In such embodiments, the coupler 1525 may laterally separate from the coupler 1550 in response to actuation of the control member 1555 in order to disengage from and eject the buoy 1505.

Although various embodiments have been described with reference to the Figures, other embodiments are possible. For example, some embodiments of a marker buoy deployment system (MBDS) may be integrated into the body or hull of a watercraft. A rescue boat, for example, may be manufactured with at least one MBDS on the port and/or starboard side of the hull, above the waterline. Some embodiments may integrally be formed in the aft portion of the watercraft, for example, in a vertical plane aligned with a central keel. Some integrally formed MBDS may include a magazine loading system, to load a buoy automatically into the launch module that may be integrally formed into a forward part of the hull. In various implementations, the deployment module may launch along a vector at an acute angle (e.g., not orthogonal) with respect to a line tangent to the hull at the location of the launch module. In some implementations, the launch module may be integrally formed by a boat manufacturer into the superstructure supported by the hull. For example, the launcher may be elevated above the deck. In some implementations, the orientation, including bearing and angle with respect to the horizontal, may be adjustable, for example, in response to command to target the buoy to land in the water based on a GPS location identified by the user, for example, on a GPS display. In some embodiments, a fish finder may identify a location, suggest that location to the operator for approval, and in response to an operator approval command, a control system may aim the bearing and/or angle of the launch module according to a calculated trajectory in order to deploy the buoy as close to the approved target location as possible.

In some embodiments, a magazine may be loaded with more two or more marker buoys. As each marker buoy is deployed, the magazine will present another to the deployment system. In some embodiments, as each marker buoy is loaded into the deployment system, the deployment system is made ready for launching the buoy. In some embodiments, a manual actuator may load the buoy from the magazine to the launching chamber. In some embodiments, launching a buoy will automatically result in another buoy being loaded into the launching chamber.

In some embodiments, a buoy deployment system may be built into a side of a boat. In some embodiments, a buoy deployment system may be attached to a surface of a boat. A buoy deployment system may be attached using bolts and/or screws, for example. A buoy deployment system may be attached using an adhesive (e.g., tape, glue, etc.). A buoy deployment system may be attached using cable. In some embodiments, the tether may have a dynamic allocation method. For example, when deployed, the anchor may fall to the bottom of the body of water. And as the anchor descends, the tether is released.

Various methods of launching a buoy may be used. For example some launching mechanisms may include a spring. Some launching mechanisms may use a pneumatic system. Some launching mechanisms may use a chemical reaction to cause the buoy to launch. Some launch mechanisms may provide user adjustability as to launch speed.

In an illustrative embodiment, power may be provided to a launch system using electricity. In some embodiments, electricity may power the launch mechanism. In an exemplary embodiment, electricity may provide power to indicators and/or launch control mechanisms. For example, in an exemplary embodiment, the launch system may draw power from the battery of a boat. In some embodiments, the launch system may have a battery dedicated to supplying its own power. In an exemplary embodiment, a solar panel may provide charge for the battery. In some embodiments, the launch mechanism may be mechanical. For example, in some embodiments, loading a marker buoy into a launch chamber may compress a spring which will provide energy to the marker buoy, when launched. In some embodiments, a chemical charge may provide energy to the marker buoy when launched. In an illustrative example, solar power may provide power to electronic circuity systems, while the launch system may be mechanical. For example, electronic circuits may be used to indicate various status metrics (e.g., buoy loaded, safety position, etc.), which may be provided power via a solar cell.

Various types of buoys may be launched using buoy launch systems. For example, rescue buoys may be launched from a boat to a person who falls overboard. In some systems, the launching device may be capable of aiming A gimbaled mount may be pointed in a direction of a victim in the water, and the buoy launched in the direction of the victim. In some embodiments, the launch system may have a range finder. The velocity of the buoy may be automatically adjusted to correspond to the bearing and distance to the victim.

In some embodiments, the indicators may be mechanical. For example, a safety indicator may be mechanically coupled to a safety lever. When the safety lever is in launch mode, the safety indicator may indicate launch mode. When the safety lever is in a safe mode, the safety indicator may indicate safe mode. In some embodiments, the indicators may be illuminated. In some embodiments, a sound may notify a user of an empty chamber when attempting deployment, for example.

Various control systems may be used for controlling marker buoy deployment systems. For example, an exemplary marker buoy deployment system may include a fish finder interface. For example, a control system may automatically deploy a marker buoy when predetermined criteria have been met. A controller may make a decision based on inputs from the fish finder and predetermined launch criteria. The controller may receive the predetermined launch criteria by user input, for example. The controller may determine a fit metric based upon a comparison of the fish finder data and the predetermined launch criteria. When the fit metric exceeds a predetermined threshold, the controller may send a launch signal to a launch sequence module, for example. An exemplary launch criterion may include the detection of fish. For example, when ten or more fish reside within a certain area of sea floor, the criterion may be met. Or when one or more fish is detected and a certain sea-floor topography is detected, a marker buoy may be launched. In some embodiments, a buoy deployment system may include a buoy retrieval system. For example, a directional indicator may point to the nearest deployed buoy.

Some aspects of embodiments may be implemented as a computer system. For example, various implementations may include digital and/or analog circuitry, computer hardware, other sensors (e.g., temperature sensors), firmware, software, or combinations thereof. Apparatus elements can be implemented in a computer program product tangibly embodied in an information carrier, e.g., in a machine-readable storage device, for execution by a programmable processor; and, methods can be performed by a programmable processor executing a program of instructions to perform functions of various embodiments by operating on input data and generating an output. Some embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer. For example, wearable devices, such as Google Glass, may facilitate input and/or output operations between a user and a system.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g/n, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A marker buoy deployment system, the system comprising:

a buoy comprising an anchor coupled to a floating member by a tether wound around the floating member, wherein the anchor comprises:

a body portion; and, a retaining member extending longitudinally from a first edge of the anchor, wherein the first edge and the retaining member define an aperture and the body portion further defines two shoulders connecting the first edge to two respective lateral edges of the anchor; and, wherein the float member comprises:

a recessed pocket configured to freely releasably receive the anchor;

a buoy launch cassette comprising a launch cavity formed to receive the buoy in a distal aperture;

a user command input control;

a locking member having a proximal-facing surface of a hook operable to engage a distal-facing surface of the retaining member in a locked mode, such that the hook holds the retaining member and the buoy in a fixed position within the buoy launch cassette, and operable to disengage the distal-facing surface of the retaining member in an unlocked mode, such that outward movement of the retaining member and the buoy from the buoy launch cassette is unrestricted by the hook;

a drive member operatively coupled to the locking member and responsive to the user command input control, wherein when the buoy is loaded into the buoy launch cassette, the locking member engages the distal-facing surface of the retaining member in the locked mode, and in response to a launch command received at the user command input control, the drive member causes the locking member to disengage the distal-facing surface of the retaining member in the unlocked mode; and, an accelerator module that imparts acceleration to the buoy in a distal direction in the unlocked mode.

2. The system of claim 1, the buoy launch cassette further comprising:

two opposing U-shaped side channels, each of the side channels extending longitudinally from a proximal end to a distal end along coplanar parallel axes, each of the side channels U-shape opening toward the other; and, a central U-shaped channel extending longitudinally along a coplanar axis orthogonal to the axes of the two opposing channels, the central channel having opposite ends connecting to each of the proximal ends of the side channels, the central channel U-shape opening toward the distal end of the side channels.

3. The system of claim 2, wherein the side channels and the central channel are formed of a unitary body construction.

4. The system of claim 2, wherein the side channels and the central channel are formed substantially from plastic.

5. The system of claim 1, wherein the user command input control further comprises a foot pedal.

6. The system of claim 1, wherein the user command input control further comprises an electronic signal received from a remote controller.

7. The system of claim 1, further comprising a biasing element to urge the locking member in a direction to maintain engagement with the distal-facing surface of the retaining member in the locked mode.

8. The system of claim 1, wherein the accelerator module further comprises a spring.

9. The system of claim 1, wherein the accelerator module further comprises two springs, each of the springs being disposed in laterally spaced and fixed location relative to a rigid portion of a proximal wall.

10. The system of claim 1, further comprising a payload sensor module operable to detect and generate a signal indicative of the presence or absence of the buoy in the cassette.

11. A marker buoy deployment system, the system comprising:

a buoy comprising an anchor coupled to a floating member by a tether wound around the floating member, wherein the anchor comprises:

a body portion; and, a retaining member extending longitudinally from a first edge of the anchor, wherein the first edge and the retaining member define an aperture; and, wherein the float member comprises:

a recessed pocket configured to freely releasably receive the anchor;

a buoy launch cassette comprising a launch cavity formed to receive the buoy in a distal aperture;

a user command input control;

a locking member having a proximal-facing surface of a hook operable to engage a distal-facing surface of the retaining member in a locked mode, such that the hook holds the retaining member and the buoy in a fixed position within the buoy launch cassette, and operable to disengage the distal-facing surface of the retaining member in an unlocked mode, such that outward movement of the retaining member and the buoy from the buoy launch cassette is unrestricted by the hook;

a drive member operatively coupled to the locking member and responsive to the user command input control, wherein when the buoy is loaded into the buoy launch cassette, the locking member engages the distal-facing surface of the retaining member in the locked mode, and in response to a launch command received at the user command input control, the drive member causes the locking member to disengage the distal-facing surface of the retaining member in the unlocked mode; and, an accelerator module that imparts acceleration to the buoy in a distal direction in the unlocked mode.

12. The system of claim 11, wherein the launch cavity is formed of a unitary body construction.

13. The system of claim 12, wherein the launch cavity is formed from a unitary sheet or plate of a metallic substance.

14. The system of claim 12, wherein the launch cavity is formed substantially from plastic.

15. The system of claim 11, wherein the user command input control further comprises a foot pedal.

16. The system of claim 11, wherein the user command input control further comprises an electronic signal received from a remote controller.

17. The system of claim 11, further comprising a biasing element to urge the locking member in a direction to maintain engagement with the distal-facing surface of the retaining member in the locked mode.

18. The system of claim 11, wherein the accelerator module further comprises a spring.

19. The system of claim 11, wherein the accelerator module further comprises two springs, each of the springs being disposed in laterally spaced and fixed location relative to a rigid portion of a proximal wall.

20. The system of claim 11, further comprising a payload sensor module operable to detect and generate a signal indicative of the presence or absence of the buoy in the cassette.

* * * * *